US006926616B1

(12) United States Patent
Kusumoto et al.

(10) Patent No.: US 6,926,616 B1
(45) Date of Patent: Aug. 9, 2005

(54) GOLF CLUB HEAD

(75) Inventors: Harunobu Kusumoto, Saitama (JP); Akinori Sasamoto, Saitama (JP)

(73) Assignee: Daiwa Seiko, Inc., Tokyo (JP)

( * ) Notice: Subject to any disclaimer, the term of this patent is extended or adjusted under 35 U.S.C. 154(b) by 298 days.

(21) Appl. No.: 09/522,296

(22) Filed: Mar. 9, 2000

(30) Foreign Application Priority Data

| | | |
|---|---|---|
| Jul. 13, 1999 | (JP) | 11-199339 |
| Aug. 13, 1999 | (JP) | 11-229440 |
| Aug. 24, 1999 | (JP) | 11-236750 |
| Oct. 21, 1999 | (JP) | 11-299516 |

(51) Int. Cl.[7] ..... A63B 53/02
(52) U.S. Cl. ..... 473/305; 473/345; 473/314; 473/349; 473/324
(58) Field of Search ..... 473/324, 329, 473/345, 346, 305–315, 350, 349

(56) References Cited

U.S. PATENT DOCUMENTS

| | | | | |
|---|---|---|---|---|
| 3,819,181 | A | * | 6/1974 | Mills |
| 4,438,931 | A | * | 3/1984 | Motomiya |
| 5,042,806 | A | * | 8/1991 | Helmstetter |
| 5,232,224 | A | * | 8/1993 | Zeider |
| 5,421,577 | A | * | 6/1995 | Kobayashi |
| 5,556,097 | A | * | 9/1996 | Endo |
| 5,575,723 | A | * | 11/1996 | Take |
| 5,931,742 | A | * | 8/1999 | Nishinura |
| 5,961,394 | A | * | 10/1999 | Minabe |
| 6,033,318 | A | * | 3/2000 | Drajan |

FOREIGN PATENT DOCUMENTS

| | | | |
|---|---|---|---|
| GB | 2225725 | * | 6/1990 |
| GB | 2230459 | * | 10/1990 |
| JP | 10015118 | | 1/1998 |
| JP | 10295857 | | 11/1998 |

* cited by examiner

*Primary Examiner*—Sebastiano Passaniti
(74) *Attorney, Agent, or Firm*—Liniak Berenato & White

(57) ABSTRACT

A golf club head of the present invention. A cast head body 31 is constituted by a hollow outer shell. Said hollow outer shell define a top portion 35, a sole portion 37, a heel wall 45, a toe portion 39 and a face opening portion 33. A shaft securing portion 43 is formed adjacent to the heel wall and extended from the top portion to the sole portion. And a first hollow portion 47 is formed between the shaft securing portion and the heel wall of the head body.

24 Claims, 18 Drawing Sheets

GOLF CLUB HEAD

BACKGROUND OF THE INVENTION

The present invention relates to a golf club head having a structure that the strength of a shaft securing portion for securing a shaft to the body of the club head is increased and the balance of weight is improved and a manufacturing method therefor.

In recent years, the head bodies of golf club heads (hereinafter called "heads") of golf clubs called the "woods" have widely been used, the head bodies each incorporating a hollow outer shell made of a metal material, such as titanium or stainless steel. The metal material is employed as a substitute for a general natural wood, such as a persimmon tree or a cherry tree, from viewpoints of stability of the quality and easiness of material acquisition.

Hitherto, a method of manufacturing a head of the foregoing type has been known which is arranged as shown in FIGS. 29 and 30. That is, a metal material, such as titanium, is used to mold a top member 201, a face member 203, a neck member 205 and a bottom member 211 constituted by integrating a sole portion 207 and side portion 209 with each other by forging or pressing so that a head 213 is manufactured (refer to JP-A-8-19626).

The neck member 205 has an outer shape constituted by a bevel head 215 formed into substantially a tapered curved surface having the width which is enlarged downwards and a cylindrical portion 217 formed into a pipe-like shape and integrated with the bevel head 215. As shown in FIG. 30, each periphery of the bevel head 215 and the leading end of the cylindrical portion 217 is welded to the top member 201, the bottom member 211 and the sole portion 207.

A shaft (not shown) is secured to the inside portion of a shaft securing hole 219 vertically formed in the neck member 205.

Another method of manufacturing the head (not shown) has been known with which a head body constituted by a hollow outer shell is molded by casting, and a face plate is welded to an opened face portion. A shaft securing portion is integrally molded with the heel portion of the head body. A shaft securing hole is formed in the shaft securing portion in a region from the top portion to the sole portion.

However, the cast golf club head incorporating the shaft securing portion and the head body molded integrally with each other, suffers from the following problem: the molding material is usually accumulated in between the shaft securing portion and the heel wall of the head body during the manufacturing process. Therefore, the manufactured head encounters excessive enlargement of the thickness of the portion in the vicinity of the shaft securing portion because the shaft securing portion is integrated with the heel wall. Hence it follows that the weight of the heel portion is enlarged, causing the balance of weight to deteriorate.

On the other hand, the former golf club head is manufactured by forging or press-molding, and incorporating the top member, the face member, the shaft securing pipe and the bottom member which are molded integrally with one another. The golf club head has the hollow portion formed between the heel wall of the head body and the shaft securing pipe. Therefore, the weight of the portion in the vicinity of the shaft securing portion can be reduced, causing the balance of weight to be improved. If the shaft securing pipe is welded insufficiently, there is apprehension that the welded portion is broken owing to an impact. Since a plurality of the members, such as the top member, the face member, the shaft securing pipe and the bottom member, are welded when the golf club head is manufactured, there arises a point-out problem in that greater manhours and cost are required as compared with the forged head.

A golf club head 13 has been disclosed in JP-A-10-15118. As shown in FIGS. 26 and 27, the golf club head 13 has a heel portion of a head body 1 constituted by a hollow outer shell. A shaft securing portion 5 having a shaft securing hole 3 and formed into a cylindrical shape having a bottom is, by forging, downwards molded from a top portion 9 such that a clearance is created between a heel wall 7 and the shaft securing portion 5. Moreover, a forged face member 11 is welded to an opening of the head body 1 adjacent to the face such that the forged face member 11 is disposed apart from the shaft securing portion 5.

Since the foregoing golf club head 13 has the clearance between the shaft securing portion 5 and the heel wall 7, the weight of the portion in the vicinity of the shaft securing portion 5 can be reduced.

The golf club head 13 incorporating the shaft securing portion 5 which does not reach a sole portion 15 of the head body 1, however, suffers from insufficient strength of the shaft securing portion 5. There arises another problem in that a satisfactorily large area for bonding the shaft (not shown) cannot be obtained.

In the above-mentioned structure disclosed in JP-A-10-15118, a fact is described that the lower end of the shaft securing portion 5, the heel wall 7 and the sole portion 15 may be connected to each other with connecting members (not shown). No disclosure is made about the shape and strength of the connecting member. Moreover, a satisfactory area for bonding the shaft cannot be obtained.

In JP-A-10-295857, a golf club head 29 has been disclosed which has a structure as shown in FIG. 28. That is, a cylindrical shaft securing portion 25 having a shaft securing hole 23 formed from its top portion to a sole portion 21. The cylindrical shaft securing portion 25 is integrally molded with the heel portion of a head body 17 constituted by a hollow outer shell made of a metal material, such as a titanium alloy or stainless steel. Moreover, clearance S is created between the shaft securing portion 25 and a heel wall 27 of the head body 17. However, whether or not the foregoing general structure molded by casting has not been disclosed. What is worse, a technical issue for creating the clearance S between the shaft securing portion 25 and the heel wall 27 has not been disclosed. In addition, no description has been made about the structure, operation and the effect of the structure.

The manufacturing method shown in FIGS. 29 and 30 causes a hollow portion 47 to be formed between the heel wall 220 of the head 213 and the cylindrical portion 217. Therefore, the weight of the portion in the vicinity of the shaft securing portion can be reduced, causing the balance of weight to be improved. However, there arises a pointed-out problem in that great manhours and cost are required to manufacture the golf club head because the plural elements, such as the top member 201, the face member 203, the neck member 205 and the bottom member 211, are welded to one another.

As described above, the head 213 has the structure that each of the periphery of the bevel head 215 of the neck member 205 and the leading end of the cylindrical portion 217 is welded and secured to the top member 201, the bottom member 211 and the sole portion 207. If the foregoing elements are welded insufficiently, there is apprehension that the welded portion is broken owing to an impact.

There arises another problem in that use of the individual neck member 205 inhibits reliably large strength of the shaft securing portion.

On the other hand, the general head incorporates the shaft securing portion and the head body which are molded integrally by casting. Moreover, the face plate is welded to the integrated elements. In usual, the foregoing head encounters accumulation of the molding material between the shaft securing portion and the head body when the head is manufactured. Thus, the manufactured head is structured such that the shaft securing portion is integrated with the heel wall. Although the strength of the shaft securing portion can, therefore, be increased as compared with the head 213, the thickness of the portion in the vicinity of the shaft securing portion is undesirably enlarged. Thus, there arises a problem in that the weight of the heel portion is enlarged, causing the balance of weight of the head to deteriorate.

In view of the foregoing, an object of the present invention is to provide a golf club head having a structure that the strength of a shaft securing portion for securing a shaft to the body of the club head is increased and the balance of weight is improved and a manufacturing method therefor.

SUMMARY OF THE INVENTION

According to the present invention, there is provided a golf club head including:

a cast head body constituted by a hollow outer shell;

said hollow outer shell defining a top portion, a sole portion, a heel wall, a toe portion and a face opening portion;

a shaft securing portion formed adjacent to said heel wall and extended from said top portion to said sole portion; and a first hollow portion formed between said shaft securing portion and said heel wall of said head body.

According to another aspect of the present invention, there is provided a method of manufacturing a head body of a hollow golf club head including a shaft securing portion extending from a top portion to a sole portion and a hollow portion between said shaft securing portion and a heel wall, wherein a mold piece for forming said hollow portion is interposed between portions corresponding respectively to said shaft securing portion and said heel wall.

The constructed golf club head incorporates the shaft securing portion which is firmly supported by a top portion of and the sole portion of the head body. Moreover, the shaft can reliably be joined to the head through the shaft securing portion.

The above-mentioned method of manufacturing a head is arranged such that the mold member is interposed between portions corresponding to the molded shaft securing portion and the heel wall to cast the head body. Thus, the hollow portion can be molded between the shaft securing portion and the heel wall by the mold member.

DETAILED DESCRIPTION OF PREFERRED EMBODIMENTS

Embodiment of the present invention will now be described with reference to the drawings.

Figure 1:
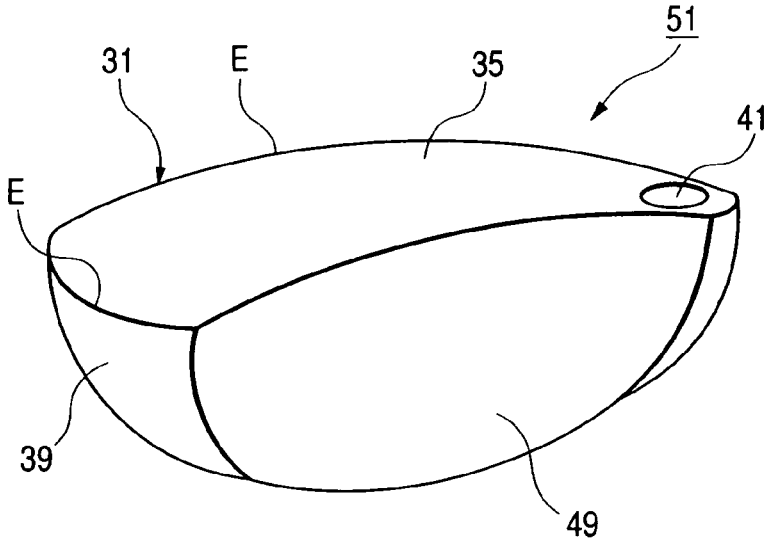
FIG. 1 is an overall perspective view showing a head according to an embodiment of the present invention.
Figure 2:
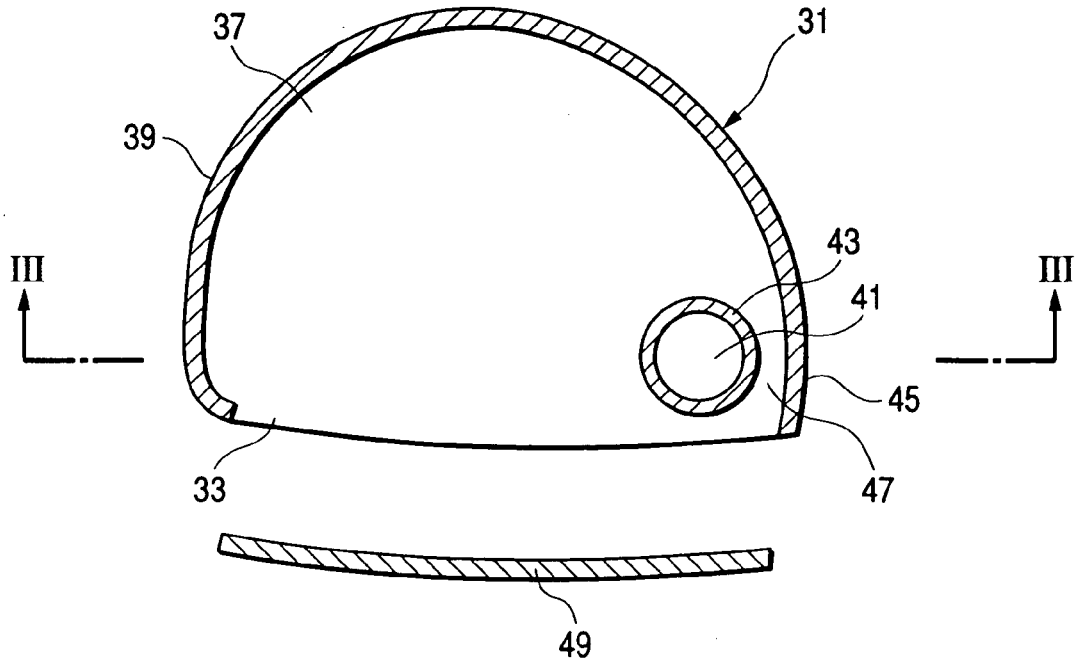
FIG. 2 is an exploded horizontal cross sectional view showing the head shown in FIG. 1.

FIGS. 1 to 4 are diagrams showing a golf club head (hereinafter called a "head") according to an embodiment of the invention. Referring to FIGS. 1 and 2, reference numeral 31 represents a head body formed into a hollow outer shell constituted by integrally molding a top portion 35, a sole portion 37 and a side portion 39 with one another with a titanium alloy, such as Ti-6Al-4V, except for a face-side opening 33. The head body 31 has a thickness of 0.3 mm to 2.0 mm except for boundary portions with the top portion 35, the sole portion 37 and the side portion 39. When an identical thickness of 0.8 mm to 1.5 mm is employed, concentration of stresses of a struck ball can be prevented. Thus, an advantage can be realized in that the head 51 cannot easily be broken.

Figure 3:
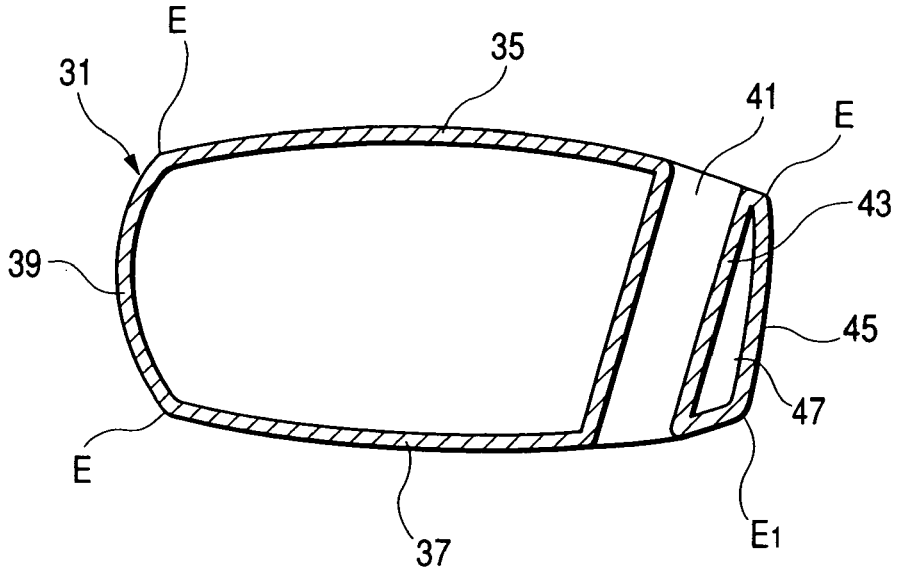
FIG. 3 is a cross sectional view taken along line III—III shown in FIG. 2.

As shown in FIG. 3, a heel portion of the head body 31 has a cylindrical shaft securing portion 43 formed integrally therewith, the shaft securing portion 43 being formed from the top portion 35 to the sole portion 37 and having a shaft securing hole 41 formed therein. The upper end of the shaft securing portion 43 is lower than the apex of the top portion 35 (the highest portion of the top portion 35 when the head 51 is laid down on the ground at the angle of lying).

When the thickness of the shaft securing portion 43 is the same as or smaller than that of a heel wall 45 to be described later, the weight corresponding to the reduced thickness can be dispersed to the periphery of the head 51. Therefore, the inertia moment which is produced when a ball is struck can be raised. Therefore, it is preferable that the thickness of the shaft securing portion 43 is smaller than 1.0 mm. The shaft securing portion 43 has the same outer diameter from the top portion 35 to the sole portion 37.

To prevent breakage occurring when a ball is struck by increasing the rigidity of the head body 31, an edge E is formed in each of boundary portions among the top portion 35, the sole portion 37 and the side portion 39, as shown in FIGS. 1 and 3. Each edge E must have a size permitting an edge line to be formed with which the top portion 35, the sole portion 37 and the side portion 39 are deformed to adjacent portions. A bent portion formed into a wedge-like shape facing side is formed on the inside of the head body 31.

A hollow portion 47 is formed between the shaft securing portion 43 and the heel wall 45 of the head body 31 such that a clearance of 1 mm to 10 mm, preferably 2 mm to 10 mm, is created. To raise the inertia moment while the center of gravity of the head 51 is being lowered, the hollow portion 47 is widened in a portion adjacent to the top portion of the head body 31 as compared with a portion adjacent to the heel portion of the head body 31. The heel wall 45 has a thickness of 0.3 mm to 2 mm.

As shown in FIG. 3, the sole portion 37 extends toward the heel portion over the shaft securing portion 43. An edge E1 is formed in the boundary portion between the sole portion 37 and the heel wall 45. As described above, the edges E and E1 are provided for the top portion and the sole portion, respectively, the edges E and E1 being formed adjacent to the heel portion of the head body 31 as compared with the shaft securing portion 43. Thus, edges E and E1 reinforce the heel wall 45 to endure the stress of the struck ball so that breakage of the heel wall 45 is prevented.

As described above, this embodiment has the structure that the heel wall 45 is provided with both of the edges E and E1 to reinforce the heel wall 45. Only the edge E1 is able to reinforce the heel wall 45. Note that a bent portion formed into a wedge-like shape facing side and corresponding to the edge E1 is formed on the inside of the head body 31.

Figure 4:
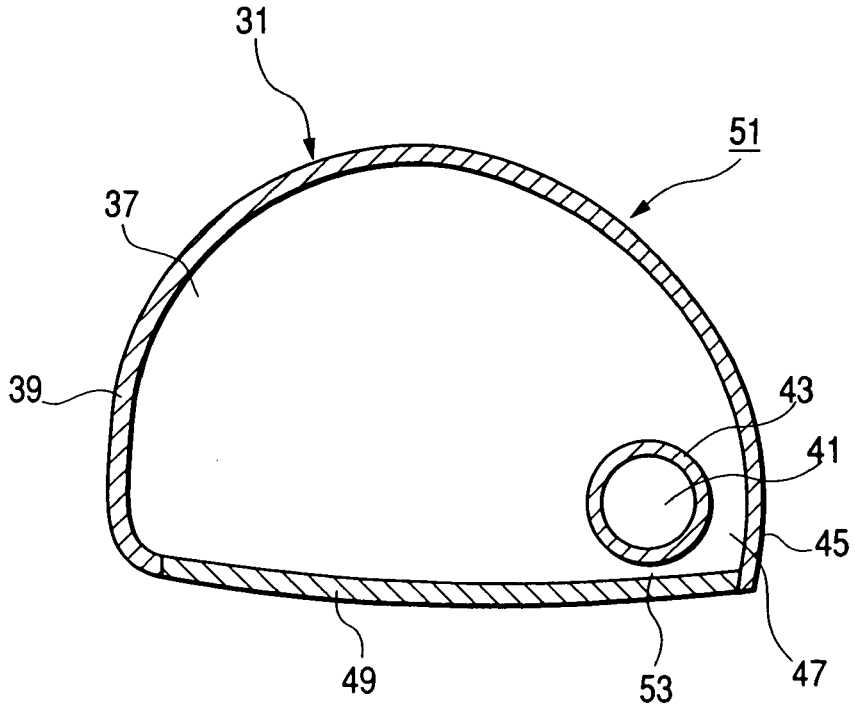
FIG. 4 is a horizontal cross sectional view showing the head shown in FIG. 1.

As shown in FIGS. 2 and 4, a face plate 49 made of a metal material, such as a titanium alloy (for example, a β-type titanium alloy, such as Ti-15Mo-5Zr-3Al), and obtained by a plastic process, such as forging or press-molding, is welded to the face-side opening 33 of the head body 31. Thus, the hollow head 51 made of metal as shown in FIG. 1 is manufactured.

When a rolled plate member is employed to constitute the face plate 49, the rolling direction is made to be the direction between the top and the sole, breakage of the face in the direction between the top and the sole in which breakage easily occur can be prevented. In this embodiment, the face plate 49 has a thickness of 1.8 mm to 3.2 mm.

As shown in FIG. 4, a hollow portion 53 is formed between the shaft securing portion 43 and the face plate 49 such that a small clearance is created. As a result of employment of the foregoing structure, sufficiently large repulsive force of the face plate 49 which is generated when a ball is struck can be obtained.

The head 51 according to this embodiment is structured as described above. The head 51 is manufactured by the following manufacturing method.

When the head 51 is manufactured, a master model of the original shape of the head body 31 is molded by a metal material to cast the head body 31. To manufacture a wax mold similar to the master model, a split pattern accurately corresponding to the master model is molded with a metal material.

Figure 5:
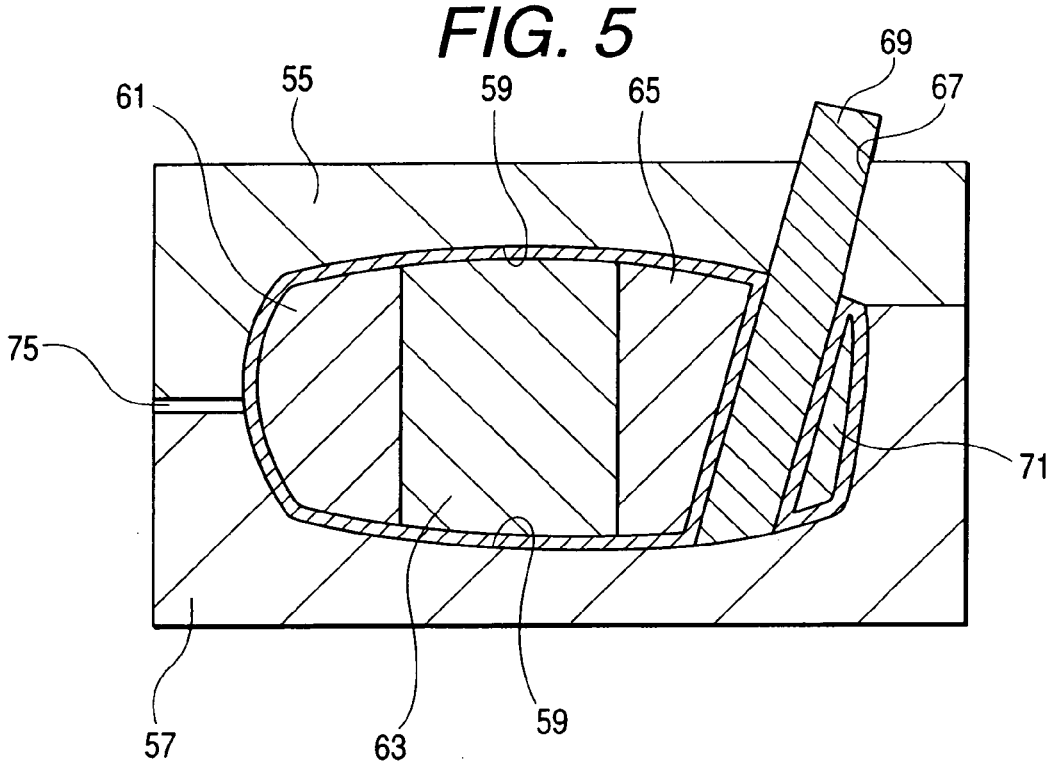
FIG. 5 is a diagram showing a method of manufacturing the head shown in FIG. 1.
Figure 6:
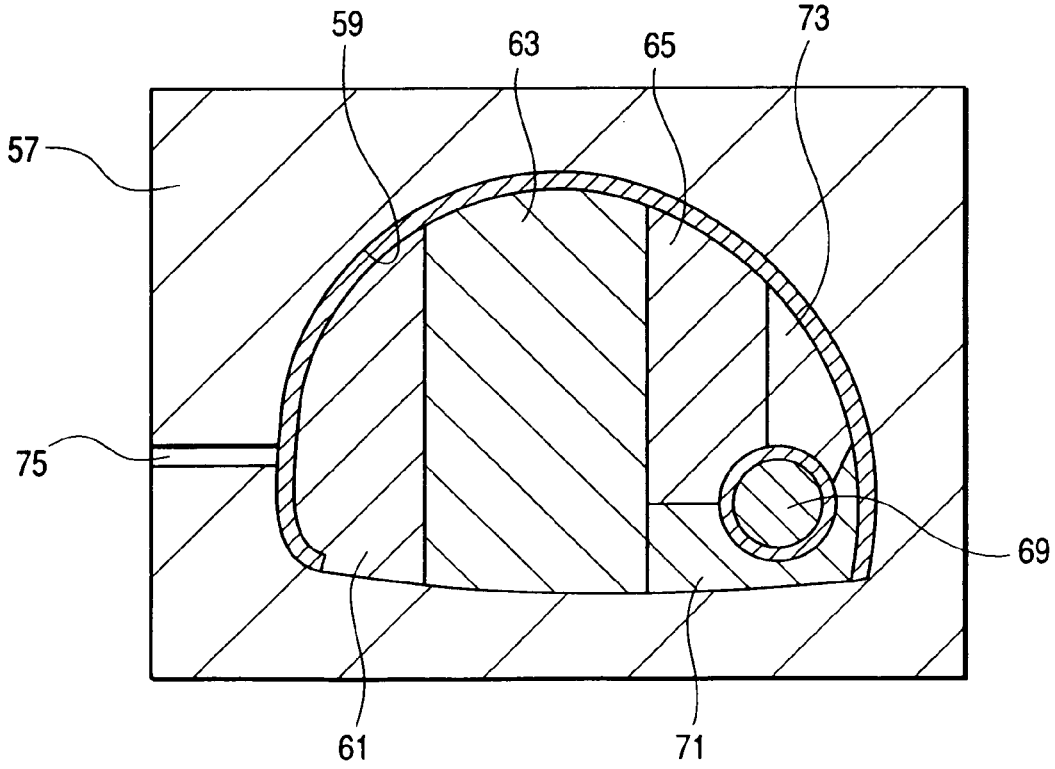
FIG. 6 is a diagram showing a method of manufacturing the head shown in FIG. 1.

As shown in FIGS. 5 and 6, the split pattern incorporates an upper mold 55 and a lower mold 57 each of which is formed into a block shape; three cores 61, 63 and 65 disposed in a cavity 59 formed by the upper mold 55 and the lower mold 57; a pin (a mold for molding the shaft securing hole) 69 penetrating a pin insertion hole 67 formed in the upper mold 55 and having a leading end of the insertion portion thereof disposed in the cavity 59; and two face-side mold member 71 and back-side mold member 73 disposed in the heel portion. The mold members 71 and 73, the pin 69 and the core 65 constitute the shaft securing portion 43. Moreover, hollow portions 47 and 53 are formed among the molded shaft securing portion 43, the heel wall 45 and the welded face plate 49.

As shown in FIGS. 5 and 6, the split pattern is assembled, and then wax is poured into the cavity 59 through a pouring gate 75 formed between the upper mold 55 and the lower mold 57.

Figure 7:
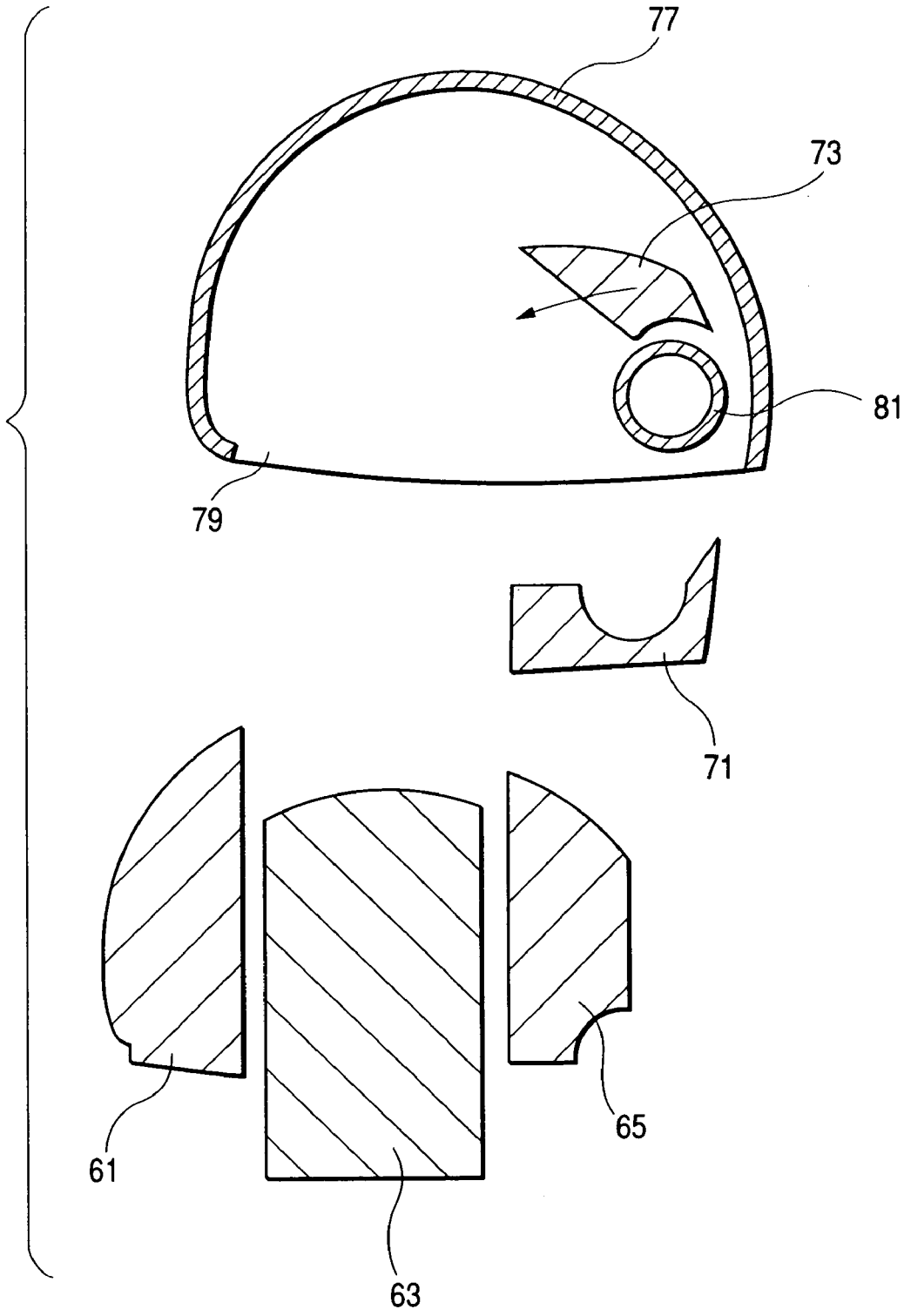
FIG. 7 is a diagram showing a method of manufacturing the head shown in FIG. 1.

After the wax has been solidified, the upper mold 55 and the lower mold 57 are opened so that the cores 61, 63 and 65 and the face-side mold member 71 are sequentially extracted through a face-side opening 79 of a wax mold 77 molded into the same shape as the head body 31, as shown in FIG. 7. Then, a back-side mold member 73 is, along a shaft securing portion 81 of the wax mold 77, moved in a direction indicated with an arrow so as to similarly be extracted through the face-side opening 79. Moreover, the pin 69 is removed. Thus, the wax mold 77 is molded.

Then, an investment process, a lost-wax process, a pouring process and a process for breaking the ceramic outer wall are performed so that the head body 31 is molded. The investment process is a process with which ceramic solution composed of a binder and ceramic powder is, like a coating of "tempura", caused to adhere to the surface of the molded wax mold 77. As an alternative to this, the wax mold 77 is repeatedly immersed in ceramic solution so that the thick ceramic outer wall is formed around the wax mold 77.

The casting die enclosed with the ceramics is dried, and then heated so that the wax in the casting die is eluted. Thus, a ceramic mold corresponding to the shape of the wax mold 77 is produced inside. The foregoing lost wax process is performed as described above.

Then, the ceramic mold is heated so that the molten metal for casting the head body 31 is poured into the ceramic mold (the casting process).

After, the ceramic mold is cooled so that the molten metal is solidified, the ceramic mold is fractured to permit, and the head body 31 having the shaft securing portion 43 molded integrally with the heel portion is extracted as shown in FIG. 2. Then, the face plate 49 is welded to the face-side opening 33 of the head body 31 so that the head 51 structured as shown in FIG. 1 is manufactured.

Then, a shaft (not shown) is inserted into the shaft securing hole 41 to make the leading end of the insertion portion to be flush with the bottom of the sole portion 37.

Figure 26:
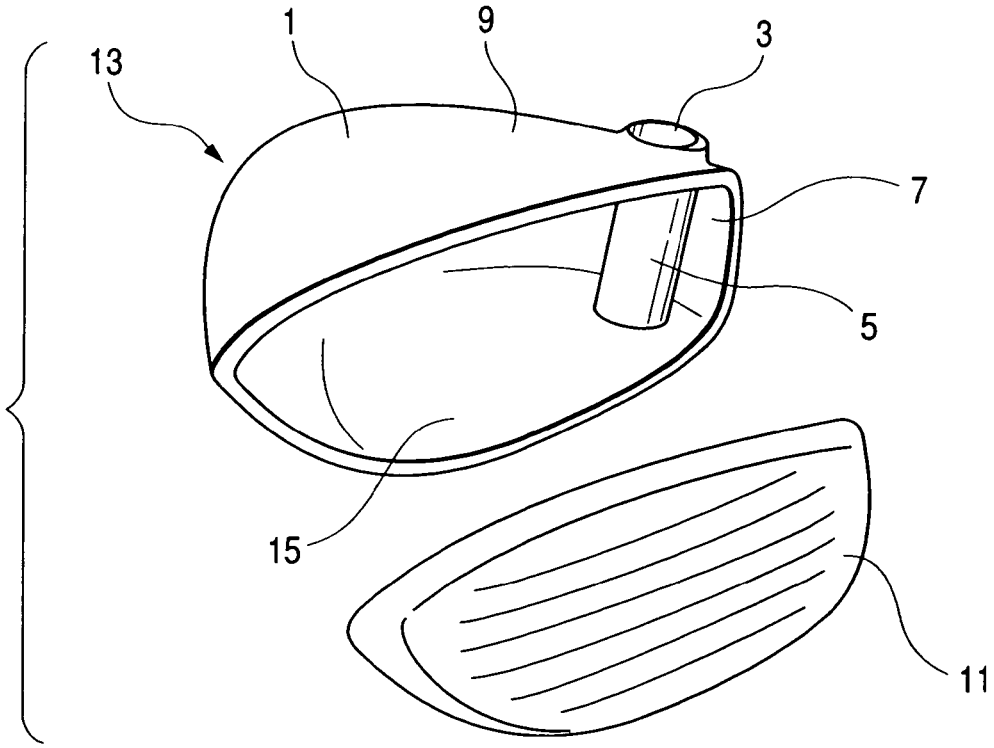
FIG. 26 is an exploded perspective view showing a general head.
Figure 27:
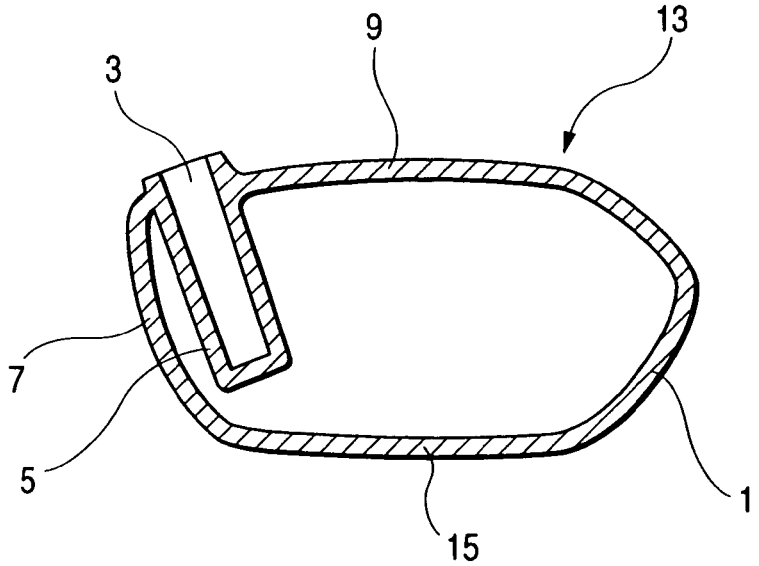
FIG. 27 is a vertical cross sectional view showing the head shown in FIG. 14.
Figure 28:
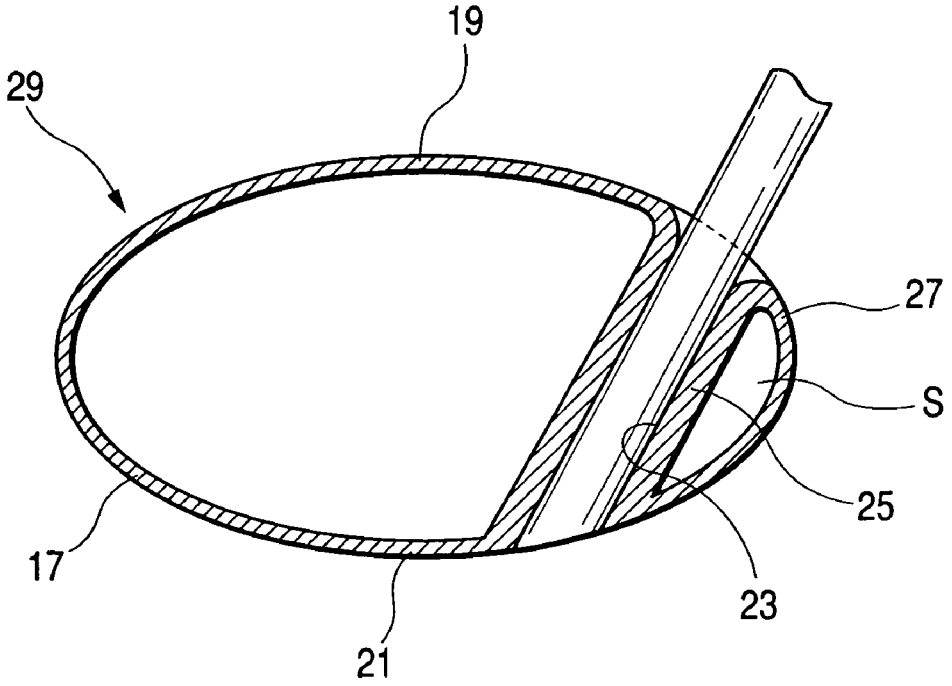
FIG. 28 is a vertical cross sectional view showing another general head.

As described above, the head 51 according to this embodiment incorporates the shaft securing portion 43 having the shaft securing hole 41 which has the opening formed from the top portion 35 to the sole portion 37. The shaft securing portion 43 is integrally arranged between the top portion 35 and the sole portion 37. Thus, the shaft securing portion 43 can firmly be supported by the top portion 35 and the sole portion 37 as compared with the general structure shown in FIG. 26. Thus, the shaft can reliably be joined to the head 51 through the shaft securing portion 43.

The hollow portions 47 and 53 are formed between the shaft securing portion 43 and the heel wall 45 and between the shaft securing portion 43 and the face plate 49, respectively. Since the portion of the hollow portion 47 adjacent to the top portion is larger than the portion of the same adjacent to the heel portion, the center of gravity of the head 51 can be lowered in addition to the reduction in the weight of the heel portion of the head 51. Moreover, the shaft securing portion 43 does not reduce the repulsive force of the face plate 49 when a ball is struck.

The edges E and E1 provided for the top portion and the sole portion of the heel wall 45 reinforce the heel wall 45 against the stress produced when a ball is struck. Thus, breakage of the heel wall 45 can be prevented.

Since the heel wall 45 has the small thickness of 0.3 mm to 2 mm, the capacity of the head 51 can be enlarged when the head 51 is molded with the metal material in a predetermined quantity. Since the head 51 is enlarged, the inertia moment of the head 51 can be enlarged. When the capacity of the head body is 270 cc (270 ml) and the inertia moment (in the direction between the toe and the heel) is 3000 g.cm2 or greater, deflections of the head can satisfactorily be prevented.

Therefore, this embodiment is able to reduce the manufacturing cost similarly to the general cast head as compared with the forged head and the press-molded head. Moreover, weight reduction of the portion in the vicinity of the shaft securing portion 43 enables the balance of weight of the head 51 to be improved as compared with the general cast head. As compared with the general structure shown in FIG. 26, the strength with which the shaft is joined to the head 51 can be increased. As compared with a structure that the shaft securing portion is joined to the head body, the structure that the shaft securing portion 43 is integrally cast between the top portion 35 and the sole portion 37 of the head body 31 permits satisfactory strength of the shaft securing portion 43 to be obtained.

The head body 31 may be molded from a β-type titanium alloy as a substitute for the αβ-type titanium alloy, such as Ti-6Al-4V. In the foregoing case, the strength of the head can furthermore be increased.

As described above, this embodiment has the structure that the hollow portions 47 and 53 are formed between the shaft securing portion 43 and the heel wall 45 and between the shaft securing portion 43 and the face plate 49, respectively. Moreover, the portion of the hollow portion 47 adjacent to the heel portion is wider than the portion adjacent to the top portion. Therefore, the shaft securing portion 43 does not reduce the repulsive force of the face plate 49 when a ball is struck. Hence it follows that a satisfactory long carry of the ball is realized owing to the repulsive force of the face plate 49. In addition to the weight reduction in the heel portion of the head 51, the center of gravity of the head 51 can be lowered.

Moreover, the structure that the heel wall 45 has the small thickness of 0.3 mm to 2 mm enables the capacity of the head 51 to be enlarged if the head is molded with the metal material in a predetermined quantity. Therefore, the inertia moment of the head 51 can be enlarged. Hence it follows that a golf club head free from easy occurrence of deflection when a ball is struck and capable of easily striking the ball can be provided.

This embodiment incorporates the edges E and E1 provided for the top portion and the sole portion of the heel wall 45 against the ball striking stress. As compared with the general structure shown in FIGS. 15 and 16 and arranged such that the heel wall 45 has no edge at the upper and lower portion thereof, the strength of the heel wall 45 can be increased. Thus, breakage of the heel wall 45 can be prevented. Since the sole portion of the head 51 is in danger of collision with the surface of the ground, the edge E1 formed in the boundary portion between the heel wall 45 and the sole portion 37 protects the heel wall 45 from a shock caused when a ball is struck. Hence it follows that breakage of the heel wall 45 can reliably be prevented.

The method of manufacturing the head 51 according to this embodiment enables the shaft securing portion 43 to be integrally molded with the head body 31. As compared with the general method shown in FIG. 29 and arranged such that the individual neck portion 205 is welded, the shaft securing portion 43 can strongly be molded. As compared with the general cast product, excess material between the shaft securing portion 43 and the heel wall 45 can be removed to form the hollow portion 47. Since this embodiment is free of a necessity of welding a plurality of elements as distinct from the general structure shown in FIG. 29, manufacturing manhours and cost can be reduced. As a result, a head having a light-weight and strong portion in the vicinity of the shaft securing portion can easily be manufactured.

Figure 8:
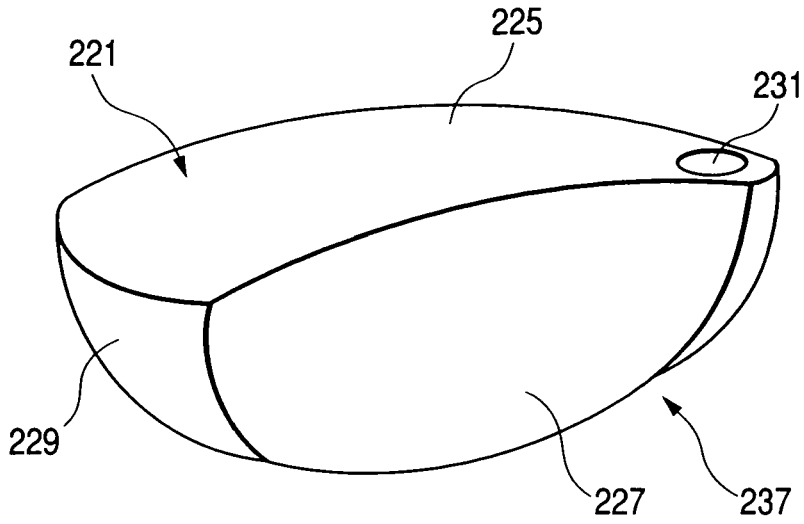
FIG. 8 is an overall perspective view showing a head manufactured by a manufacturing method according to a second embodiment of the invention.
Figure 9:
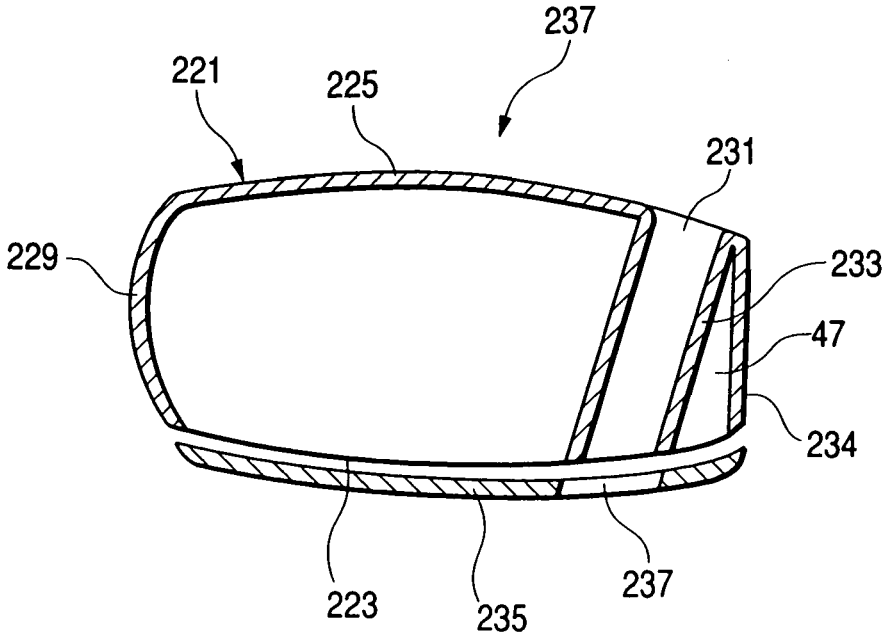
FIG. 9 is an exploded cross sectional view showing the head shown in FIG. 8.
Figure 10:
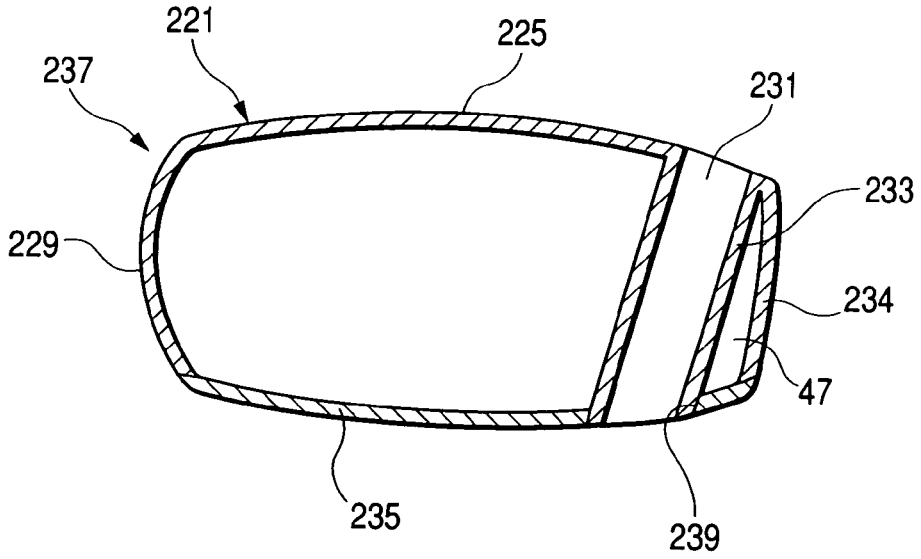
FIG. 10 is a cross sectional view showing the head shown in FIG. 8.

FIGS. 8 to 10 are diagrams showing a head manufactured by a manufacturing method according to a second embodiment. Referring to FIGS. 8 to 10, reference numeral 221 represents a head body constituted by a hollow outer shell made of a metal material, such as a titanium alloy, and incorporating a top portion 225, a face portion 227 and a side portion 229 which are integrally molded with one another except for a sole-side opening 223. A heel portion of the head body 221 incorporates a cylindrical shaft securing portion (a hosel portion) 233 in which a shaft securing hole 231 in the form of a through hole is formed from the top portion 225 to the sole-side opening 223. A hollow portion 47 is formed between the shaft securing portion 233 and the heel wall 234 of the head body 221 such that a predetermined clearance is created.

The upper end of the shaft securing portion 233 is lower than the apex of the top portion 225 (the highest portion of the top portion 225 when addressing is performed).

Another hollow portion (not shown) is formed between the shaft securing portion 233 and the face portion 227 such that a predetermined clearance is created. Since the hollow portion is provided for the foregoing portion, satisfactory repulsive force of the face portion 227 can be obtained.

As shown in FIG. 9, a sole plate 235 constituted by forging or press-molding a metal material, such as a titanium alloy, is welded to a sole-side opening 223 of the head body 221. Thus, a hollow head 237 according to this embodiment is constituted. As shown in FIG. 10, the leading end of the shaft securing portion 233 is, in a joining hole 239 formed in the sole plate 235, fitted to and flush with the bottom of the sole plate 235. The thickness of each of the shaft securing portion 233 and the head 237 is 0.3 mm to 2.0 mm except for the face portion 227.

The head 237 according to this embodiment is structured as described above. The head 237 is manufactured by a method according to the second embodiment.

When the head 237 is manufactured, a master model (a mockup) of the original of the hollow head body 221 is molded by using a metal material to cast the head body 221. To mold a wax mold similar to the master model, a split pattern is molded by using a metal material to accurately correspond to the master model.

Figure 11:
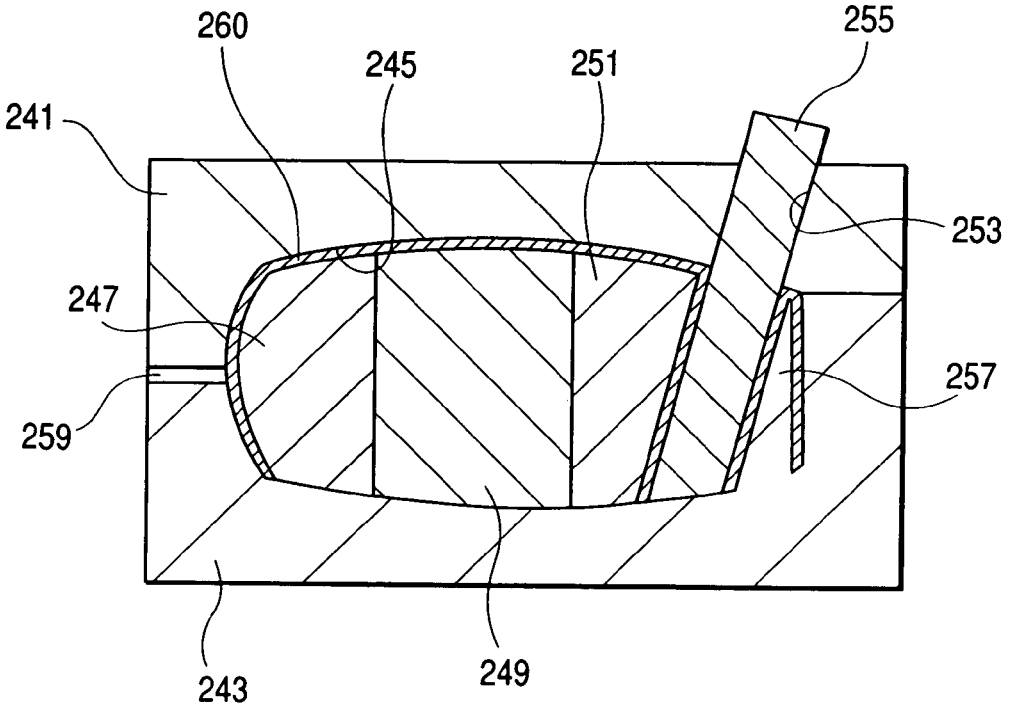
FIG. 11 is diagram showing a manufacturing method according to the second embodiment.

As shown in FIG. 11, the split pattern incorporates an upper mold 241 and a lower mold 243 each of which is formed into a block shape; cores 247, 249 and 251 disposed in a cavity 245 created by the upper mold 241 and the lower mold 243 and arranged to mold the head body 221; and a pin (a mold for molding a shaft securing hole) 255 inserted into a pin insertion hole 253 formed in the upper mold 241 and having a leading end disposed in the cavity 245. The lower mold 243 has a mold member for creating a hollow portion (hereinafter called a "mold member") having a triangular cross sectional shape projecting to the heel portion of the pin 255, the mold member 257 being integrally molded to project toward the heel portion. The mold member 257, the pin 255 and the core 251 constitute the cylindrical shaft securing portion 233. A molding process is performed such that the mold member 257 is disposed between portions corresponding to the molded shaft securing portion 233 and the heel wall 234. Thus, the hollow portion 47 is formed between the shaft securing portion 233 and the heel wall 234 owing to the mold member 257.

After the split pattern has been assembled as shown in FIG. 11, wax (bees wax) is poured into the cavity 245 through a pouring gate 259 formed at a position except for the heel wall 234. In this embodiment, a pouring gate 259 is formed between the upper mold 241 and the lower mold 243 in the toe portion of the side portion 229. After the wax has been solidified, the upper mold 241 and the lower mold 243 are separated from each other to extract the cores 247, 249 and 251 and the mold member 257 through the sole portion. Then, the pin 255 is removed so that a wax mold 260 having the same shape as that of the head body 221 shown in FIG. 9 is molded.

Then, the manufacturing method according to this embodiment is arranged such that an investment process, a lost-wax process, a pouring process and a process for breaking the ceramic outer wall are performed so that the head body is molded. The investment process is a process with which ceramic solution composed of a binder and ceramic powder is, like a coating of "tempura", caused to adhere to the surface of the molded wax mold 260. As an alternative to this, the wax mold 260 is repeatedly immersed in ceramic solution so that the thick ceramic outer wall is formed around the wax mold 260.

The casting die enclosed with the ceramics is dried, and then heated so that the wax in the casting die is eluted. Thus, a ceramic mold having the outer surface corresponding to the shape of the wax mold 260 is produced inside. The lost-wax process is performed as described above.

Then, the ceramic mold is heated so that the molten metal for casting the head body 221 is poured into the ceramic mold (the casting process).

After, the ceramic mold is cooled so that the molten metal is solidified, the ceramic mold is fractured so that the head body 31 is extracted. The cylindrical shaft securing portion 233 is integrally molded in the head body 31, as shown in FIG. 9, and the hollow portion 47 is formed between the shaft securing portion 233 and the heel wall 34 in the head body 31. Then, the sole plate 235 is welded to the sole-side opening 223 of the head body 31 while the shaft securing portion 233 is being engaged to the joining hole 239 of the sole plate 235. Thus, the head 51 shown in FIG. 8 is manufactured.

Then, a shaft (not shown) is inserted into the shaft securing hole 231 such that the leading end of the insertion portion of the shaft is made to be flush with the bottom of the sole plate 235.

Figure 29:
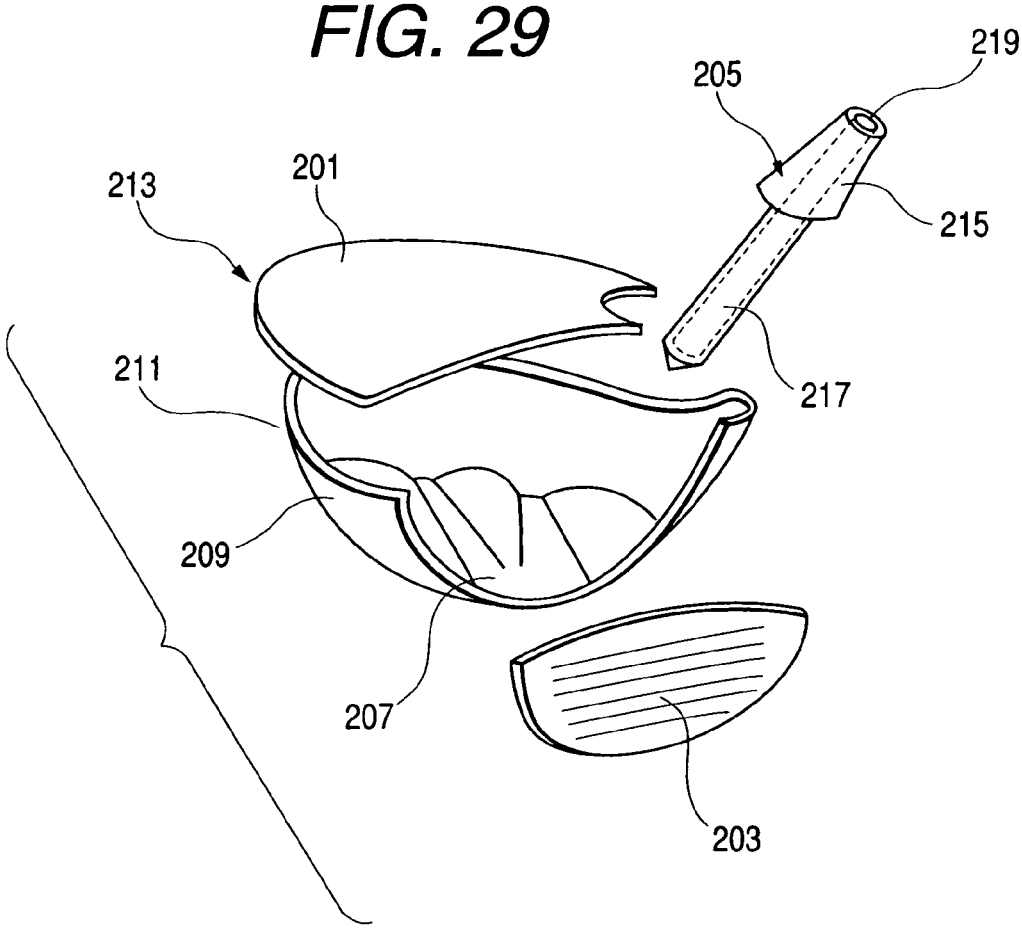
FIG. 29 is a diagram showing a general method of manufacturing a head.
Figure 30:
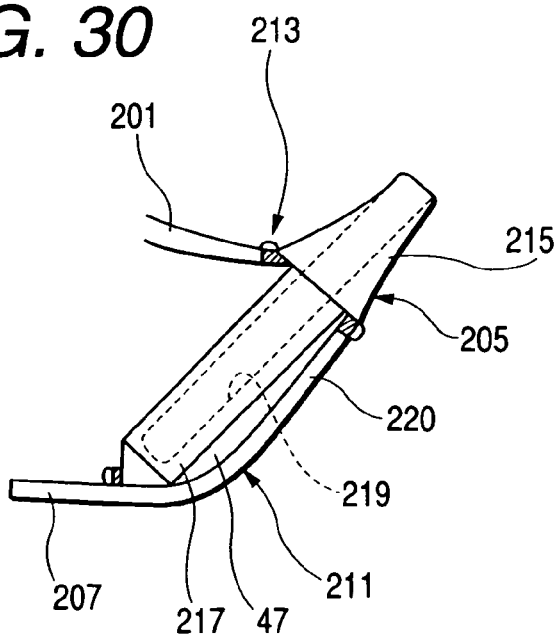
FIG. 30 is a cross sectional view showing an essential portion of the head shown in FIG. 29.

The head 237 manufactured as described above incorporates the shaft securing portion 233 for securing the shaft which is integrally molded with the head body 221. Moreover, the hollow portion 47 is formed between the shaft securing portion 233 and the heel wall 34 of the head body 221. As compared with the general structure in which the individual neck portion 205 is welded as shown in FIG. 29, the shaft securing portion 233 can firmly be joined to the head body 221. As compared with the general cast product, the weight of the heel portion of the head 51 can be reduced. As a result, the balance of weight of the head 237 can be improved so that a golf club with which a ball can easily be struck is obtained.

The method of manufacturing the head 237 according to this embodiment enables the shaft securing portion 233 to be integrally molded with the head body 221. As compared with the general method with which the individual neck portion 205 is welded, the shaft securing portion 233 can firmly be molded. As compared with the general cast product, excessive material between the shaft securing portion 233 and the heel wall 234 can be removed to create the hollow portion 47. Moreover, this embodiment is not required to weld the plural elements as distinct from the general structure shown in FIG. 29. Therefore, manufacturing manhours and cost can be reduced. As a result, a head having the shaft securing portion having a light weight can easily be manufactured.

Although this embodiment is arranged to use the pin 255 to form the shaft securing hole, the pin may be omitted such that the shaft securing hole is formed in the wax mold 260 or the head body by a drilling work.

Figure 12:
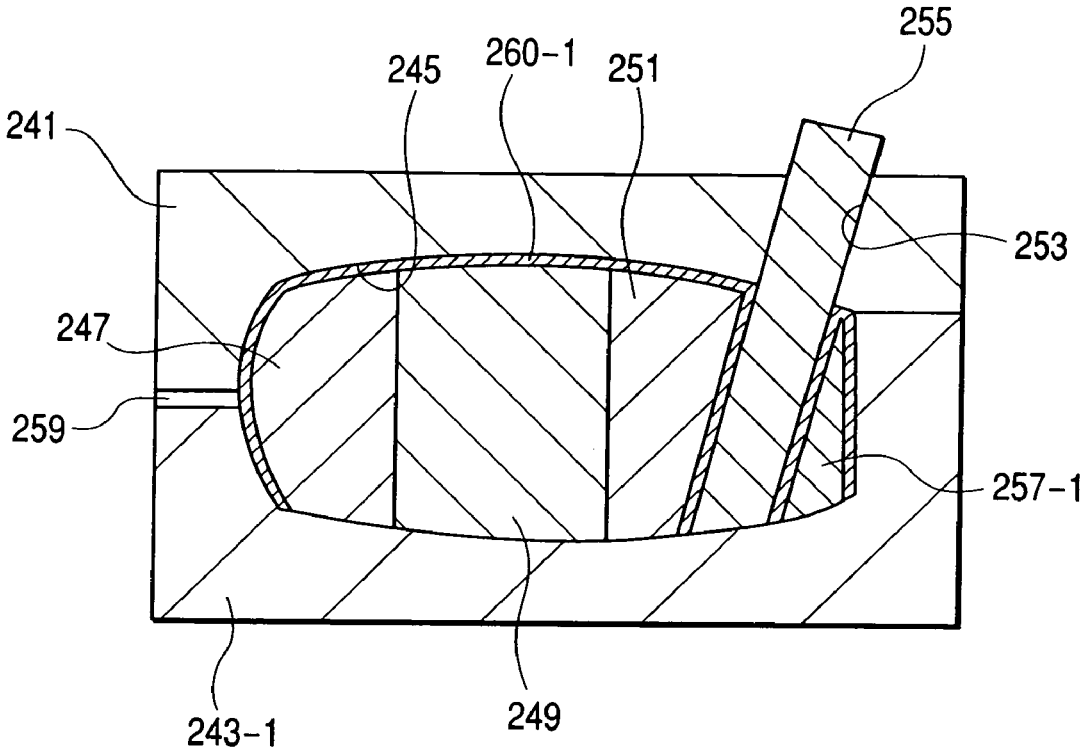
FIG. 12 is a diagram showing a manufacturing method according to a third embodiment.

FIG. 12 shows a third embodiment. Although the foregoing embodiment is structured such that the projecting mold member 257 is integrally molded with the lower mold 243. This embodiment is structured to produce the split pattern to manufacture the head body such that a mold member 257-1 having the same shape as that of the mold member 257 is molded by using ceramics such that the mold member 257-1 is individual from the lower mold 243-1.

The other split patterns for molding the wax mold are similar to those according to the foregoing embodiment. Therefore, the same elements are given the same reference numerals.

A manufacturing method according to this embodiment will now be described. Initially, as shown in FIG. 12, the cores 247, 249 and 251 and the pin 255 are joined to the inside portion of the cavity 245 constituted by the upper mold 241 and the lower mold 243-1. Moreover, a mold member 257-1 is disposed in a heel portion adjacent to the pin 255. Then, the split patterns are joined to each other.

Then, wax is poured into the cavity 245 through the pouring gate 259 formed between the upper mold 241 and the lower mold 243-1. After wax has been solidified, the upper mold 241 and the lower mold 243-1 are separated from each other to extract the cores 247, 249 and 251 through the sole portion. Then, the pin 255 is removed so that a wax mold 260-1 is formed. Note that the mold member 257-1 joined to the wax mold 260-1 is not extracted.

Then, the investment process, the lost-wax process, the pouring process and the process for breaking the outer wall of the ceramic mold are performed similarly to the foregoing embodiment. Thus, the head body is molded. When the ceramic outer wall is formed around the wax mold 260-1, the mold member 257-1 exposed over the sole portion of the wax mold 260-1 is covered.

After the casting mold enclosed by ceramics has been dried, the casting mold is heated to elute wax in the casting mold. Thus, a ceramic mold having the shape corresponding to the shape of the wax mold 260-1 is produced in the casting mold.

Then, the ceramic mold is heated, and then a molten metal material for casting the head body 221 is poured into the ceramic mold. Then, the ceramic mold is cooled to solidify the molten metal, and then the ceramic mold is fractured together with the mold member 257-1. Thus, the head body can be extracted in which the shaft securing portion 233 is integrally molded, as shown in FIG. 9, and the hollow portion 47 is formed between the shaft securing portion 233 and the heel wall.

Then, the sole plate 235 is welded to the shaft securing portion 233 of the head body 221 while the leading end of the shaft securing portion 233 is being engaged to the joining hole 239 of the sole plate 235. Thus, the head 237 structured as shown in FIG. 8 can be manufactured.

Then, a shaft (not shown) is inserted into the shaft securing hole 231 such that the leading end of the inserted shaft is made to be flush with the bottom of the sole plate 235.

As described above, also the method of manufacturing the head 237 according to this embodiment enables the shaft securing portion 233 to be molded integrally with the head body. As compared with the general method with which the individual neck portion 205 is welded, the shaft securing portion 233 can strongly be welded. As compared with the general cast product, an excessive material between the shaft securing portion 233 and the heel wall 34 can be removed to form the hollow portion 47 between the shaft securing portion 233 and the heel wall 34. Moreover, a necessity of welding the plural elements can be eliminated as distinct from the general structure shown in FIG. 29. Therefore, manufacturing manhours and cost can be reduced. Thus, a strong and lightweight head having a portion in the vicinity of the shaft securing can easily be manufactured.

Since this embodiment is arranged such that the mold member 257-1 is made of ceramics and arranged to be fractured and extracted together with the ceramic mold, the workability can be improved as compared with the general embodiment with which the metal mold member 257 is extracted from the wax mold.

Note that the mold member 257-1 may be molded with water-soluble wax as a substitute for ceramic. In this case, water-soluble wax is dissolved when extraction from the wax mold 260-1 is performed.

Each of the embodiment is structured such that the head body is molded by the precise casting method (the lost-wax method). A mold having the same shape as that of the split pattern shown in FIGS. 11 and 12 may be employed to perform a die-casting process with which a metal material is directly poured through the pouring gate 259 so that the head body is cast.

Also the foregoing manufacturing methods enable the required objects to be obtained similarly to each embodiment.

Figure 13:
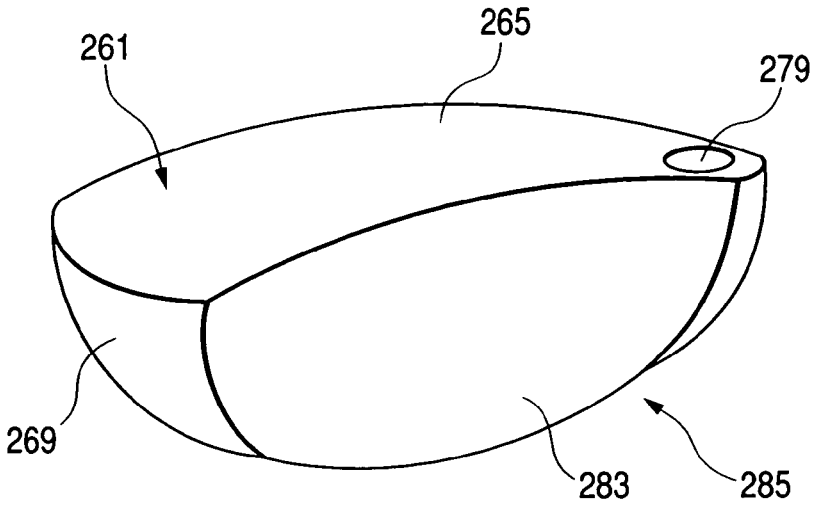
FIG. 13 is an overall perspective view showing a head manufactured by a manufacturing method according to a fourth embodiment.
Figure 14:
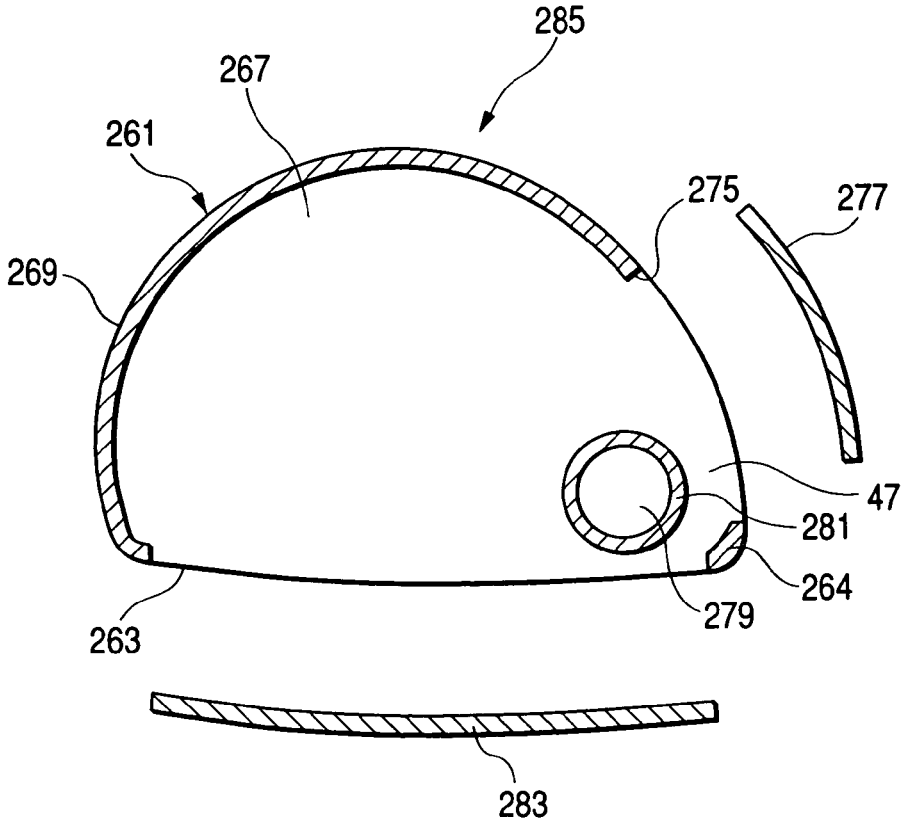
FIG. 14 is an exploded cross sectional view showing the head shown in FIG. 13.
Figure 15:
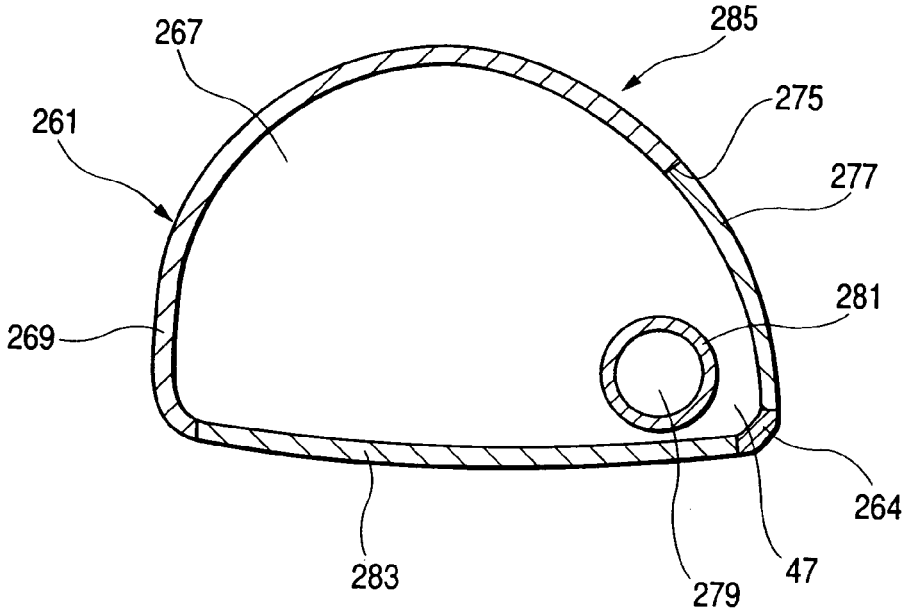
FIG. 15 is a cross sectional view showing the head shown in FIG. 13.

FIGS. 13 and 15 are diagrams showing a head manufactured by a method according to a fourth embodiment. Referring to FIGS. 13 to 15, reference numeral 261 represents a head body constituted by a hollow outer shell obtained by integrally casting a top portion 265, a sole portion 267 and a side portion 269 with a metal material, such as a titanium alloy, except for a face-side opening 263. The heel portion of the head body 261 has an extracting hole 275 through which mold members 271 and 273 to be described later are extracted. A forged or cast plate 277 is welded to close the extracting hole 275. The plate 277 and the heel member 264 molded integrally with the head body 261 constitute the heel wall of the head body 261.

As shown in FIG. 15, the heel portion of the head body 261 has a cylindrical shaft securing portion 281 in which a shaft securing hole 279 is formed from the top portion 265 to the sole portion 267 and which is integrally molded between the top portion 265 and the sole portion 267. The shaft securing portion 281 maintains the strength of the hollow head body 261. A hollow portion 47 is formed between the shaft securing portion 281 and the heel wall (the heel member 264 and the plate 277) of the head body 261.

As shown in FIG. 14, a forged or press-molded face plate 283 is welded to the face-side opening 263 of the head body 261 so that a hollow head 285 according to this embodiment is constituted.

The head 285 according to this embodiment is structured as described above. The head 285 is manufactured as follows by a method according to the fourth embodiment.

When the head 285 is manufactured, a master model for forging the head body 261 is molded with a metal material. Then, a split pattern accurately corresponding to the master model is produced by using a metal material to produce a wax model similar to the master model.

Figure 16:
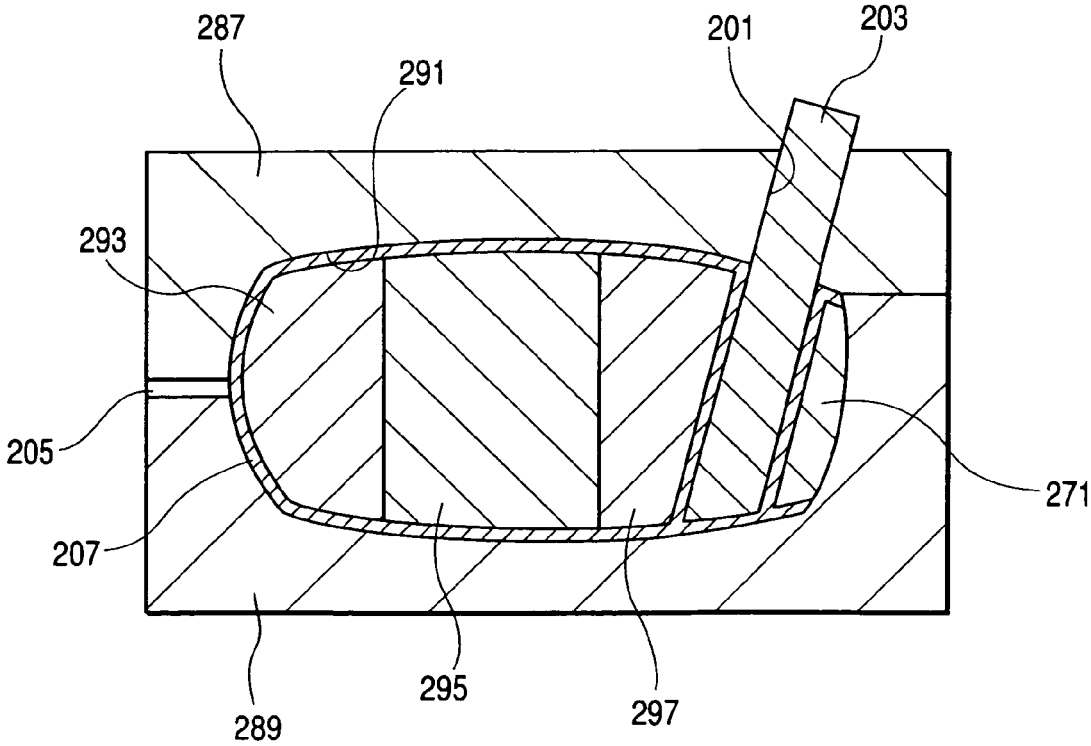
FIG. 16 is a diagram showing the manufacturing method according to the fourth embodiment.
Figure 17:
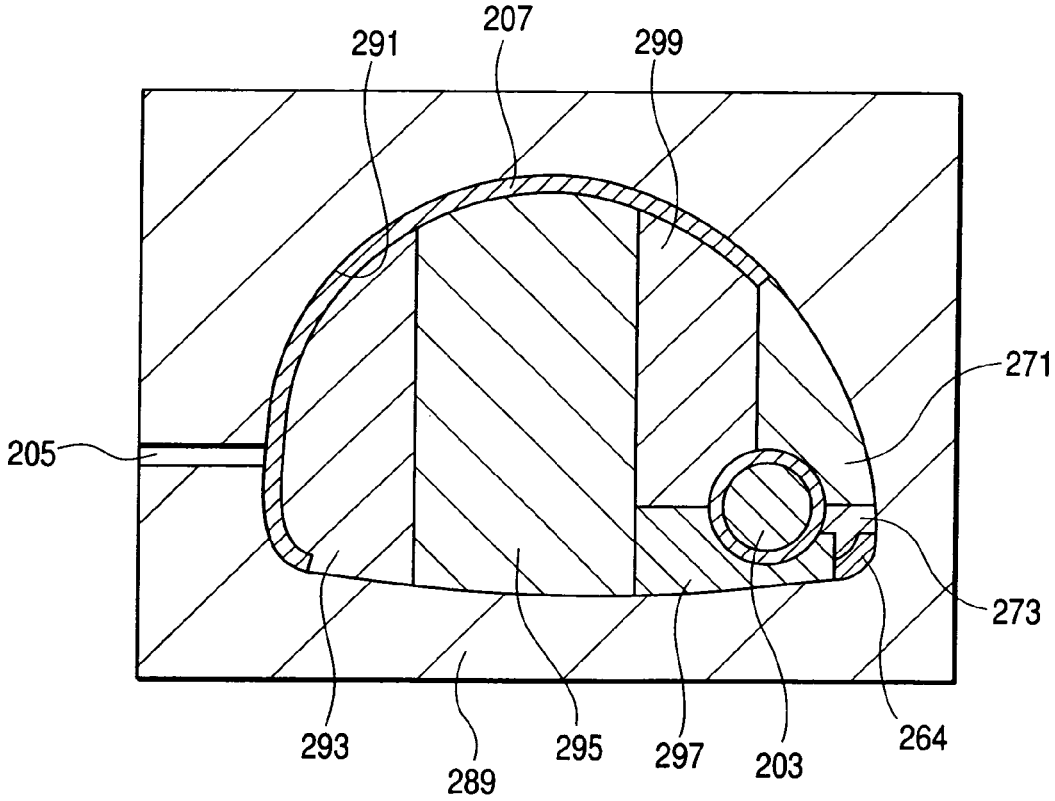
FIG. 17 is a diagram showing the manufacturing method according to the fourth embodiment.
Figure 18:
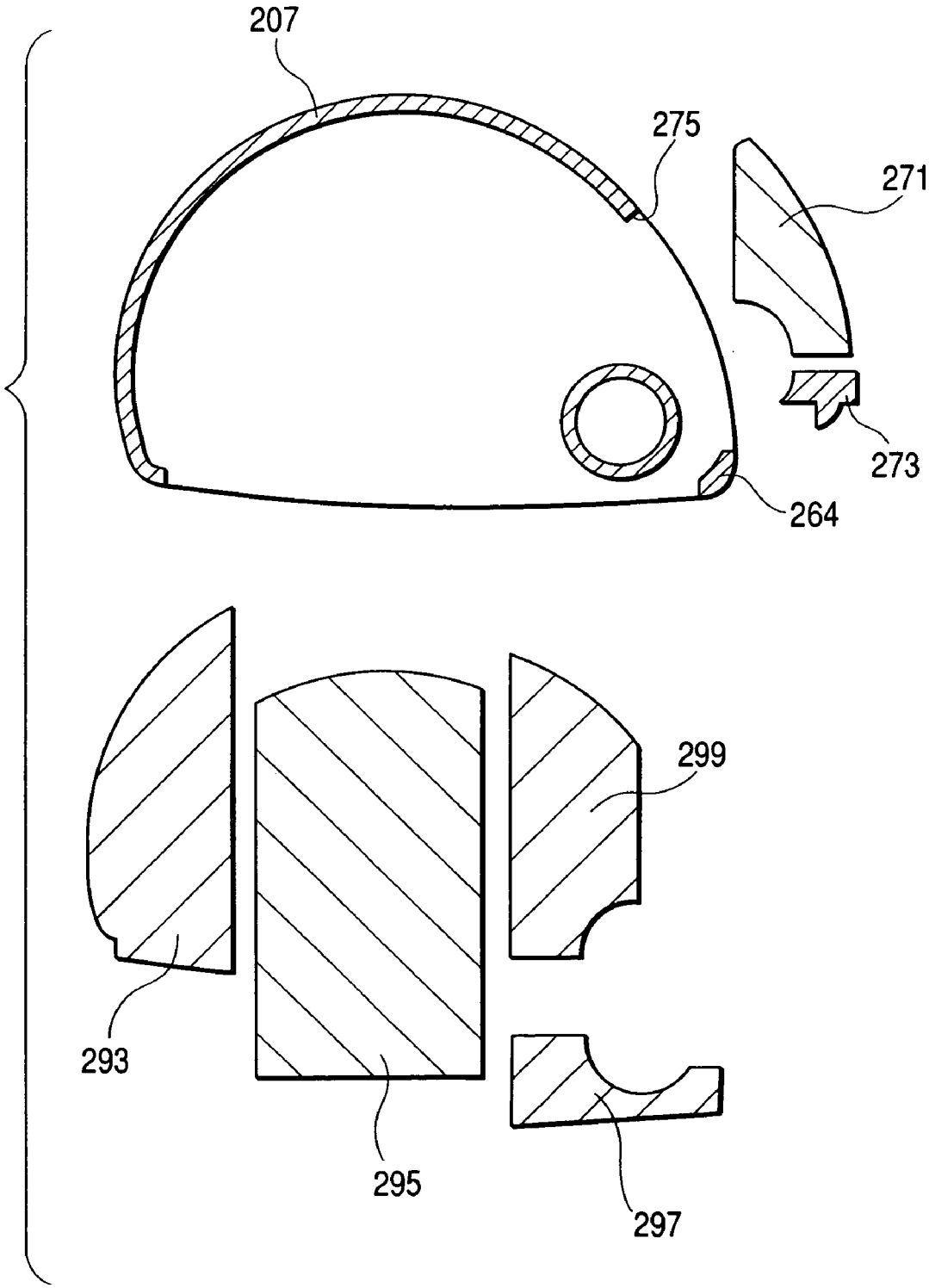
FIG. 18 is a diagram showing the manufacturing method according to the fourth embodiment.

As shown in FIGS. 16 and 17, the split pattern incorporates an upper mold 287 and a lower mold 289 which are molded into block shapes; cores 293, 295, 297 and 299 for molding the head body 261 and disposed in a cavity 291 formed by the upper mold 287 and the lower mold 289; a pin (a mold for molding a shaft securing hole) 203 penetrating a pin insertion hole 201 formed in the upper mold 287 and having a leading end disposed in the cavity 291; and two mold members 271 and 273 disposed in the heel portion. The mold members 271 and 273, the pin 203 and the cores 297 and 299 constitute the shaft securing portion 281. When a molding process is performed such that the mold members 271 and 273 are disposed at the positions corresponding to the molded shaft securing portion 281 and the heel wall, the mold members 271 and 273 enable a hollow portion 47 to be formed between the shaft securing portion 281 and the heel wall.

As shown in FIGS. 16 and 17, the split patterns are assembled, and then wax is poured into the cavity 291 through a pouring gate 205 formed between the upper mold 287 and the lower mold 289. After wax has been solidified, the upper mold 287 and the lower mold 289 are separated from each other so that the cores 293, 295, 297 and 299 are extracted from the face portion. Moreover, the mold members 271 and 273 are extracted through an extracting hole 275 formed in the heel portion. In addition, the pin 203 is removed so that wax mold 207 having the same shape as that of the head body 261 is produced.

Then, also the manufacturing method according to this embodiment is arranged to perform the investment process, the lost-wax process, the pouring process and the process for breaking the outer wall of the ceramic mold to mold the head body 261. In the investment process, a ceramic outer wall is formed around the wax mold 207.

Then, the casting mold enclosed with ceramics is dried and heated to elute the wax in the casting mold. Thus, a ceramic mold having a shape corresponding to the shape of the wax mold 207 is produced in the casting mold.

Then, the ceramic mold is heated, and then molten metal material for casting the head body 261 is poured into the ceramic mold.

Then, the ceramic mold is cooled to solidify the molten metal, and then the ceramic mold is fractured. Thus, the head body 261 having the shaft securing portion 281 which is integrally molded to the heel portion as shown in FIG. 14 can be extracted. Then, the faceplate 283 is welded to the face-side opening 263 of the head body 261, and then the plate 277 is welded to the extracting hole 275. Thus, the head 285 structured as shown in FIG. 13 can be manufactured.

The thus-manufactured head 285 has the structure that the shaft securing portion 281 for securing the shaft is integrally molded with the head body 261. Moreover, the hollow portion 47 is formed between the shaft securing portion 281 and the heel wall of the head body 261. Therefore, the shaft securing portion 281 can firmly be joined to the head body 261. As compared with the general cast product, the weight of the heel portion of the head 285 can be reduced. Therefore, the balance of weight of the head 285 can be improved. Therefore, a golf club with which a ball can easily be struck can be manufactured.

The method of manufacturing the head 285 according to this embodiment enables the shaft securing portion 281 to be molded integrally with the head body 261. As compared with the general method with which the individual neck portion 205 is welded and which is shown in FIG. 29, the shaft securing portion 281 can firmly be molded. As compared with the general cast product, an excessive material between the shaft securing portion 281 and the heel wall can be removed to form the hollow portion 47. Moreover, this embodiment is not required to weld a plurality of the elements as distinct from the general structure shown in FIG. 29. Therefore, manufacturing manhours and cost can be reduced. Therefore, a strong head incorporating a portion in the vicinity of the shaft securing portion, the weight of which can be reduced, can easily be manufactured.

In the foregoing embodiment, the extracting hole 275 through which the mold members 271 and 273 are extracted is formed in the heel portion of the head body 261. A cut portion communicated with the face-side opening may be formed in the heel portion of the head body to permit extraction of the mold members 271 and 273 from the cut portion. For example, an extracting hole for extracting the mold member may be formed in the heel portion of the top portion of the head body or an extracting hole may be formed from the heel portion to the top portion.

Also the foregoing embodiments enable the required objects to be achieved similarly to each of the foregoing embodiments.

Figure 19:
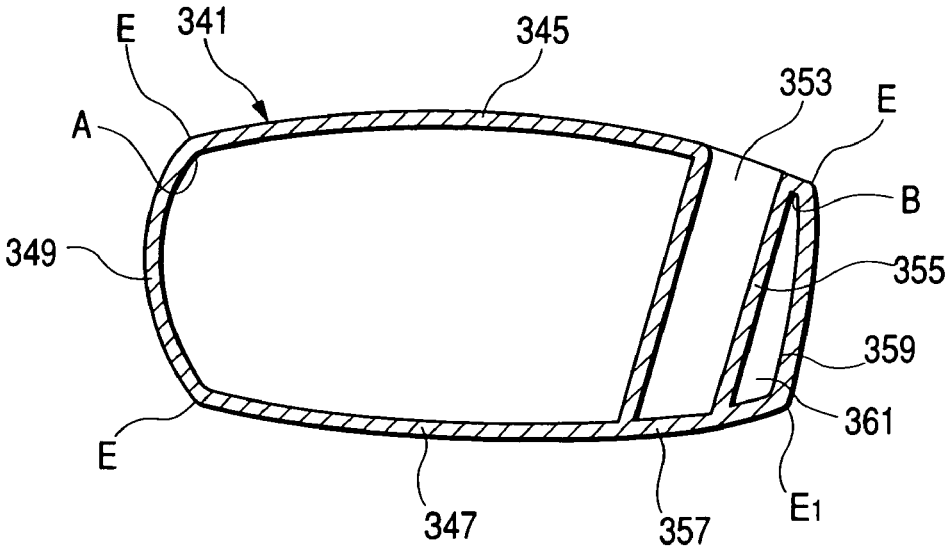
FIG. 19 is a cross sectional view showing a head according to a fifth embodiment.

FIG. 19 is a drawing showing a fifth embodiment. A head 341 according to this embodiment has a structure obtained by slightly changing the structure of the first embodiment. A shaft securing hole 353 integrally formed from a top portion 345 to a sole portion 347 of a head body 341 is downwards opened from an apex of the top portion 345. The shaft securing hole 353 reaches the sole portion 347 and incorporates a bottom portion 357, the thickness of which is the same as that of the sole portion 347.

As a matter of course, this embodiment is able to achieve the required objects similarly to the foregoing embodiment. Since the thickness of the bottom portion 357 is the same as that of the sole portion, the center of gravity of the head body can be lowered.

Figure 20:
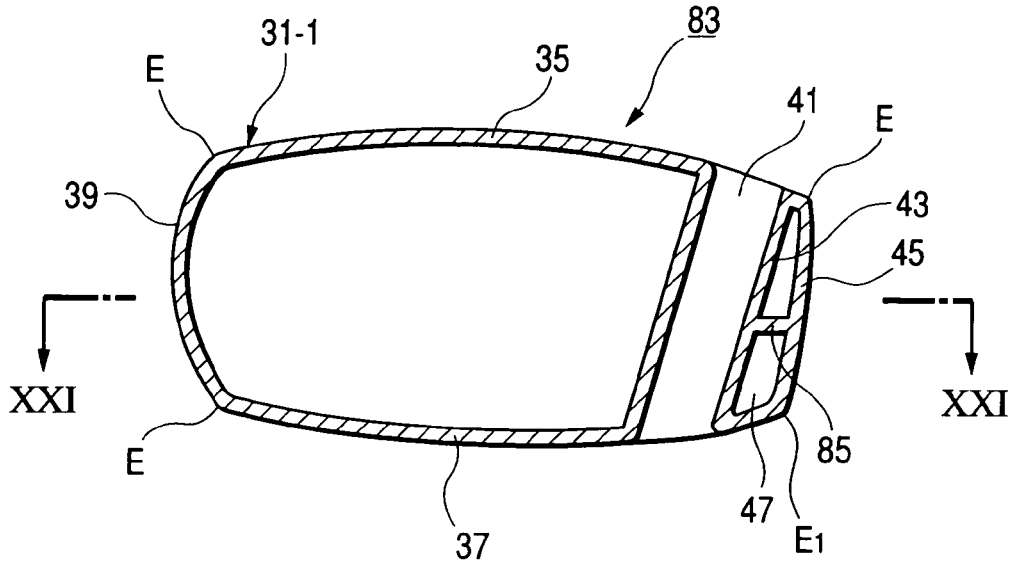
FIG. 20 is a vertical cross sectional view showing a head according to a sixth embodiment.
Figure 21:
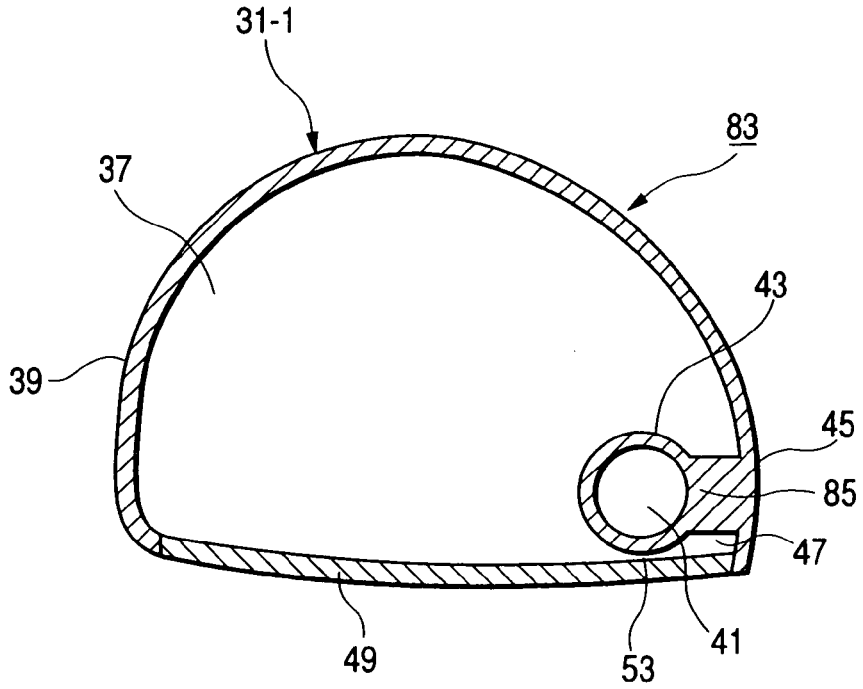
FIG. 21 is a cross sectional view taken along line IX—IX shown in FIG. 20.
Figure 22:
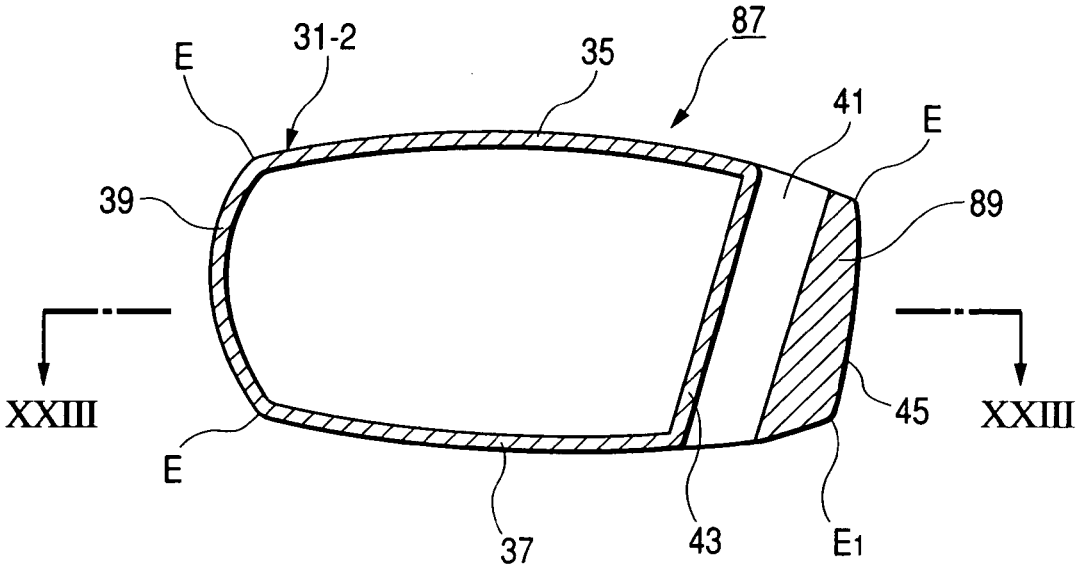
FIG. 22 is a vertical cross sectional view showing a head according to a seventh embodiment.
Figure 23:
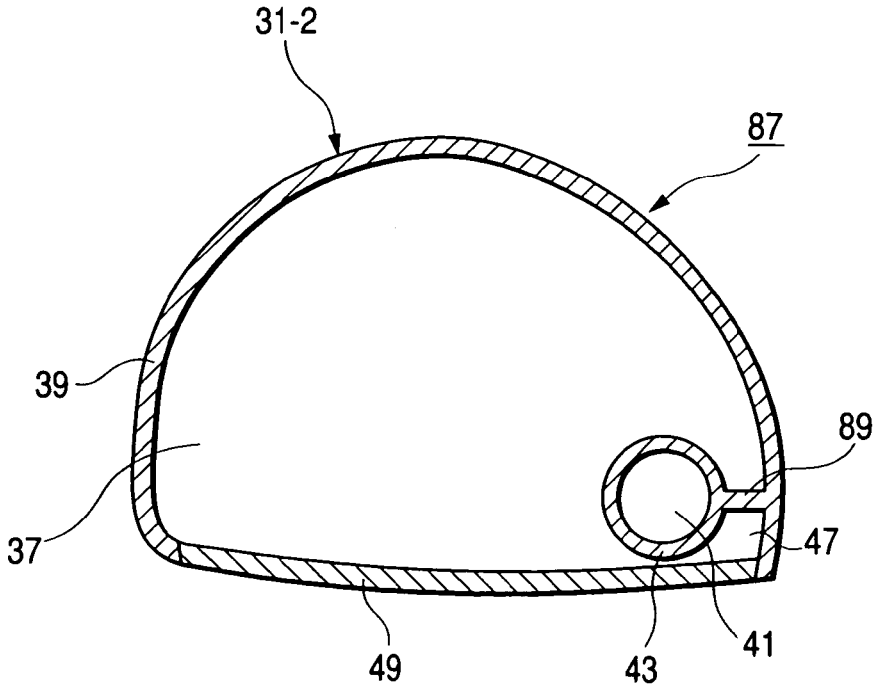
FIG. 23 is a cross sectional view taken along line XI—XI shown in FIG. 22.

When the hollow portion is formed between the shaft securing portion and the heel wall of the head body as in the embodiments, a head 83 according to a sixth embodiment shown in FIGS. 20 and 21 may be employed. That is, a thin and blade-like support column 85 for connecting the shaft securing portion 43 and the heel wall 45 to each other in the direction between the toe and the heel may integrally be molded when a head body 31-1 is manufactured. A head 87 according to a seventh embodiment shown in FIGS. 22 and 23 may be employed. That is, when a head body 31-2 is manufactured, a thin and blade-like support wall 89 for connecting the shaft securing portion 43 and the heel wall 45 to each other in the direction between the top portion and the sole portion may integrally be molded. As a matter of course, also the foregoing embodiments enable the required objects to be achieved similarly to the first embodiment. Moreover, the strength of each of the shaft securing portion 43 and the head bodies 31-1 and 31-2 can furthermore be increased without deterioration in the balance of weight of each of the heads 83 and 87.

Figure 24:
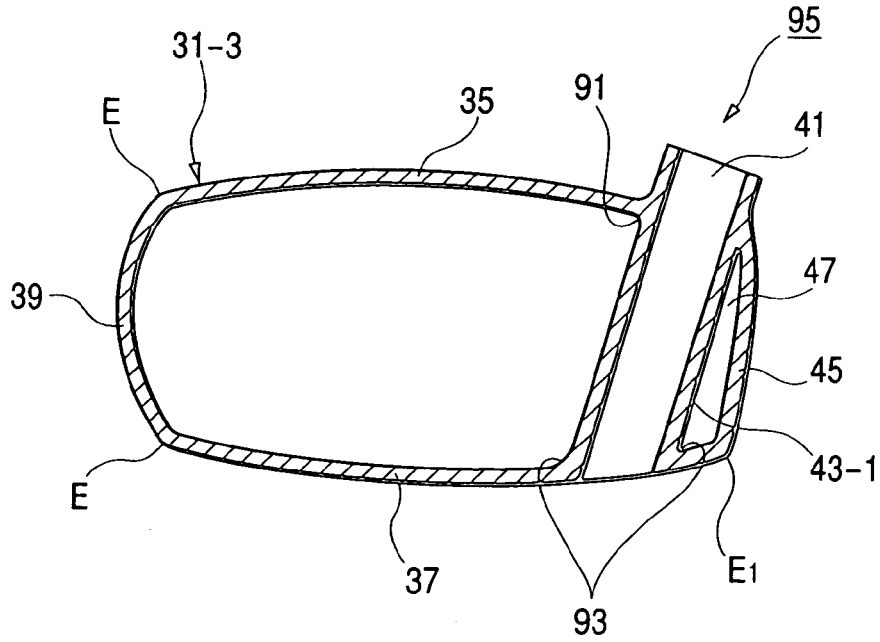
FIG. 24 is a vertical cross sectional view showing a head according to an eighth embodiment.

FIG. 24 is cross sectional view sowing a golf club head according to an eighth embodiment. Similarly to the first embodiment, this embodiment has a structure that a shaft securing portion 43-1 is formed in the heel portion of a head body 31-3. Moreover, a clearance having a size of 1 mm to 10 mm is created from the shaft securing portion 43-1 and the heel wall 45 of the head body 31-3. Thus, the portion of the hollow portion 47 adjacent to the sole portion is made to be wider than the portion of the same adjacent to the top portion. As shown in FIG. 24, the shaft securing portion 43-1 projects over the head body 31-3 so that a hosel portion similar to that of the general structure is constituted. The shaft securing hole 41 is formed from the upper end of the shaft securing portion 43 projecting upwards to the lower end of the same. That is, the shaft securing hole 41 penetrates the top portion 35 to reach the sole portion 37 of the head body 31-3.

Also this embodiment is structured such that the edge E is formed in each of the boundaries among the top portion 35, the sole portion 37 and the side portion 39. Moreover, the edge E1 is formed in the boundary between the heel wall 45 and the sole portion 37.

Connecting portions 91 and 93 between the shaft securing portion 43-1 and the top portion 35 and between the shaft securing portion 43-1 and the sole portion 37 are rounded gently. Since the connecting portions 91 and 93 are rounded as described above, the ball striking stress which is exerted from the head body 31-3 to the shaft securing portion 43-1 can be dispersed. Thus, breakage of the shaft securing portion 43-1 can be prevented.

A head 95 according to this embodiment is structured as described above. This embodiment enables the required objects to be achieved similarly to the first embodiment. As described above, this embodiment is structured such that the connecting portions 91 and 93 between the shaft securing portion 43-1 and the top portion 35 and between the shaft securing portion 43-1 and the sole portion 37 are rounded gently. Therefore, the ball striking stress which is exerted from the head body 31-3 to the shaft securing portion 43-1 can be dispersed as compared with the first embodiment. Therefore, breakage of the shaft securing portion 43-1 can furthermore reliably be prevented.

Figure 25:
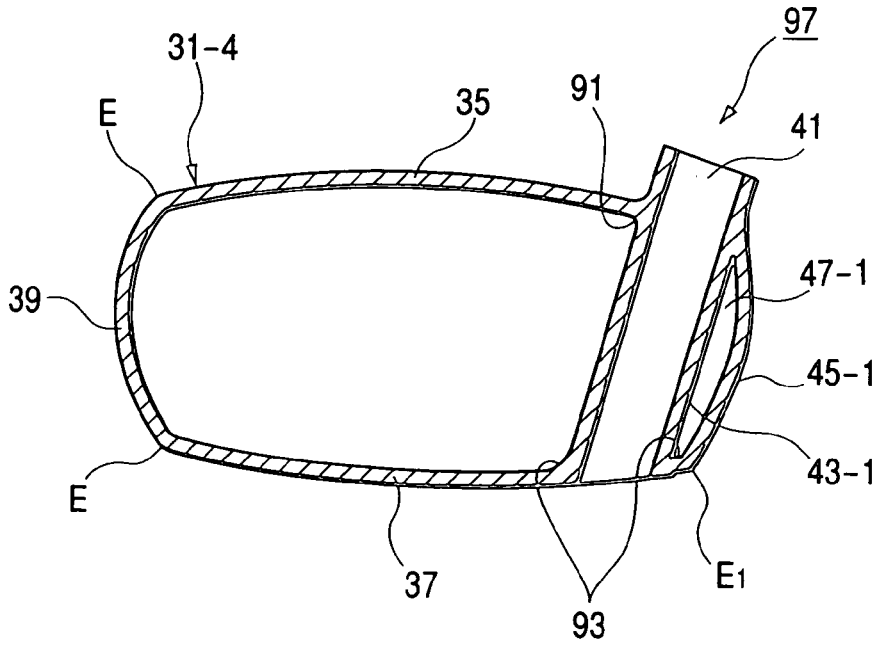
FIG. 25 is a vertical cross sectional view showing a head according to a ninth embodiment.

In each of the embodiments, the clearance having a size of 1 mm to 10 mm is created between the shaft securing portion 43 and the heel wall 45 of the head body 31. The portion of the hollow portion 47 adjacent to the sole portion is formed wider than the portion adjacent to the top portion. A necessity of widening the portion adjacent to the sole portion as compared with the portion adjacent to the top portion to create the hollow portion can be eliminated. For example, the region from the portion adjacent to the top portion to that adjacent to the sole portion may have a same width of 3 mm to 5 mm. A head 97 according to a ninth embodiment shown in FIG. 25 may be employed. That is, the head body 31-3 shown in FIG. 24 may be modified to make a hollow portion 47-1 between the top portion 35 of the head body 31-4 and the sole portion 37 to be widest by forming a heel wall 45-1 such that a clearance having a size of 1 mm to 10 mm is created from the shaft securing portion 43-1. In any case, it is preferable that the hollow portion for creating the clearance has a size of 1 mm to 10 mm.

Also this embodiment has a structure that the edge E1 is formed between the sole portion 37 and the heel wall 45-1 at a position adjacent to the heel portion as compared with the shaft securing portion 43-1 of the head body 31-4.

Therefore, each of the embodiments is able to achieve the required objects similarly to the embodiment shown in FIG. 24.

As described above, the heads of the invention can be manufactured with a low cost similarly to the general cast head as compared with the forged or press-molded head. Since the weight of the portion in the vicinity of the shaft securing portion can be reduced as compared with that of the general cast head, the balance of weight of the head can be improved. As compared with the general structure, the strength for joining the shaft to the head can be increased. Moreover, satisfactory large strength of the shaft securing portion can be maintained.

As described above, the method of manufacturing a head of the invention enables the shaft securing portion to be molded integrally with the head body. Therefore, the shaft securing portion can be strengthened as compared with the general structure with which the individual shaft securing portion is welded. Moreover, an excessive material between the shaft securing portion and the heel wall can be removed to create the clearance as compared with the general casting product. The methods according to the present invention are not required to weld a multiplicity of elements as compared with the head body obtained by forging or press-molding. Therefore, manufacturing manhours and cost can be reduced. As a result, the strong head having the portion in the vicinity of the shaft securing portion, the weight of which can be reduced, can be manufactured.

What is claimed is:

1. A golf club head comprising:

a cast body constituted by a one-piece unitary homogenous hollow outer shell;

said hollow outer shell defining a top portion, a sole portion, a heel wall, a toe portion and a face opening portion to which a face portion is to be fixed;

a shaft securing portion formed adjacent to said heel wall and extended from said top portion to said sole portion; and a first hollow portion formed between said shaft securing portion and said heel wall of said head body;

a second hollow portion formed between said shaft securing portion and said face portion, wherein said shaft securing portion is formed homogeneously with said hollow outer shell to provide a one-piece, unitary, homogenous body, and wherein said sole portion of said hollow outer shell covers substantially a whole of a bottom of said hollow outer shell.

2. A golf club head according to claim 1, wherein said hollow outer shell defines a face opening portion, a face portion is fixed to said face opening portion.

3. A golf club head according to claim 2, wherein a second hollow portion is formed between said shaft securing portion and said face portion.

4. A golf club head according to claim 2, wherein said face portion is formed by forging.

5. A golf club head according to claim 2, wherein said face portion is formed by press working of a rolled plate member.

6. A golf club head according to claim 2, wherein said head body is formed from αβ-type titanium alloy, and said face 3 portion is formed from β-type titanium alloy.

7. A golf club head according to claim 1, wherein a shaft securing hole penetrates said shaft securing portion in a region from said top portion to said sole portion.

8. A golf club head according to claim 1, wherein said shaft securing hole of said shaft securing portion has a bottom portion.

9. A golf club head according to claim 8, wherein said bottom portion is formed in a same surface of said sole portion of said head body.

10. A golf club head according to claim 8, wherein said bottom portion of said shaft securing hole has substantially the same thickness as the thickness of said sole portion.

11. A golf club head according to claim 1, wherein said hollow outer shell and said shaft securing portion are integrally molded with each other by precise casting.

12. A golf club head according to claim 1, wherein said shaft securing portion is formed into a cylindrical shape from said top portion to said sole portion.

13. A golf club head according to claim 1, wherein said first hollow portion is formed such that a clearance of 1 mm to 10 mm is defined between said shaft securing portion and said heel wall.

14. A golf club head according to claim 1, wherein said heel wall has a thickness of 0.3 mm to 2 mm.

15. A golf club head according to claim 1, wherein a width of said first hollow portion adjacent to said sole portion is wider than a width of said first hollow portion adjacent to said top portion.

16. A golf club according to claim 1, wherein as edge is formed between said sole portion and said heel wall at a heel side near said shaft securing portion.

17. A golf club head according to claim 1, wherein a first upper end of the inside portion of said toe portion is higher than a second upper end of the inside portion of said heel portion in a cross section passing through an axis of said shaft securing hole and along said face portion.

18. A golf club head according to claim 1, wherein a hosel portion is formed at said top portion of said head body by projecting said shaft securing portion from said top portion.

19. A golf club head according to claim 1, wherein an upper end portion of said shaft securing portion is provided lower than a top of said top portion.

20. A golf club head according to claim 1, wherein said head body is formed from β-type titanium alloy.

21. A golf club head comprising:

a cast body constituted by a hollow outer shell;

said hollow outer shell defining a top portion, a sole portion, a heel wall and a toe portion;

a shaft securing portion formed adjacent to said heel wall and extended from said top portion to said sole portion; and a first hollow portion formed between said shaft securing portion and said heel wall of said head body, wherein said shaft securing portion is formed homogeneously with said hollow outer shell to provide a one-piece, unitary, homogenous body, wherein a support portion connects said shaft securing portion and said heel wall.

22. A golf club head comprising:

a head body constituted by a hollow outer shell; and a shaft securing portion, homogeneously formed by casting with a top portion and a sole portion of said hollow outer shell;

wherein a hollow portion is provided between said shaft securing portion and a heel portion and between said shaft securing portion and a face portion of said outer shell, and wherein said sole portion of said hollow outer shell covers substantially a whole of a bottom of said hollow outer shell.

23. A golf club head according to claim 22, wherein a joining hole, for joining said shaft securing portion, is provided with one of said top portion and said sole portion.

24. A golf club head comprising:

a head body constituted by a hollow outer shell; and a shaft securing portion, homogeneously formed by casting with a top portion and a sole portion of said hollow outer shell; and wherein a hollow portion is provided between said shaft securing portion and a heel portion and between said shaft securing portion and a face portion of said outer shell, and wherein said shaft securing portion includes a shaft securing hole extending into said top portion and said sole portion.

* * * * *